US006409314B1

(12) United States Patent
Kitaoka et al.

(10) Patent No.: US 6,409,314 B1
(45) Date of Patent: Jun. 25, 2002

(54) IMAGE FORMING DEVICE AND IMAGE FORMING METHOD

(75) Inventors: Yoshitaka Kitaoka, Kadoma; Akira Kumon, Katano; Katsutoshi Ogawa, Hirakata; Akira Fukano, Ikoma; Masahiro Aizawa, Takatsuki; Hiroyuki Matsuo, Neyagawa, all of (JP)

(73) Assignees: Matsushita Electric Industrial Co., Ltd., Osaka (JP); Array Aktiebolag, Vastra Frolunda (SE)

( * ) Notice: Subject to any disclaimer, the term of this patent is extended or adjusted under 35 U.S.C. 154(b) by 0 days.

(21) Appl. No.: 09/601,147

(22) PCT Filed: Jan. 27, 1999

(86) PCT No.: PCT/JP99/00349

§ 371 (c)(1),
(2), (4) Date: Jul. 28, 2000

(87) PCT Pub. No.: WO99/38697

PCT Pub. Date: Aug. 5, 1999

(30) Foreign Application Priority Data

Jan. 30, 1998 (JP) ..... 10-019829
Mar. 26, 1998 (JP) ..... 10-079061

(51) Int. Cl.[7] ..... B41J 2/06
(52) U.S. Cl. ..... 347/55
(58) Field of Search ..... 347/55, 151, 120, 347/141, 154, 103, 123, 111, 159, 127, 128, 131, 125, 158; 399/271, 290, 292, 293, 294, 295

(56) References Cited

U.S. PATENT DOCUMENTS 5,966,152 A * 10/1999 Albinsson ..... 347/55

FOREIGN PATENT DOCUMENTS

| | | |
|---|---|---|
| JP | 58104771 A | 6/1983 |
| JP | 63136058 A | 6/1988 |
| JP | 3-15566 | 1/1991 |
| JP | 3-193368 | 8/1991 |
| JP | 8-276612 | 10/1996 |
| JP | 09020029 A | 1/1997 |

* cited by examiner

*Primary Examiner*—Raquel Yvette Gordon
(74) *Attorney, Agent, or Firm*—Akin, Gump, Strauss, Hauer & Feld, L.L.P.

(57) ABSTRACT

In an image forming apparatus of the present invention, image signal electrodes are provided on a flexible printed circuit base in opposing relation to a developer carrying member such that they are disposed around the openings of developer passage holes, different voltages are applied thereto during dot formation and during non-dot formation, a throttle electrode is provided on the flexible printed circuit base in opposing relation to a counter electrode, a voltage always lower than the voltage applied to the image signal electrodes is applied to the throttle electrode when a developer of negative polarity is applied, and a voltage always higher than the voltage applied to the image signal electrodes is applied to the throttle electrode when a developer of positive polarity is applied.

19 Claims, 18 Drawing Sheets

PRIOR ART (a) Sectional view of aperture (along the line A-A')

PRIOR ART (b) Apertures viewed from the top

PRIOR ART

IMAGE FORMING DEVICE AND IMAGE FORMING METHOD

BACKGROUND OF THE INVENTION

1. Technical Field

The present invention relates to an image forming apparatus and an image forming method each for use in a copier, facsimile, printer, or the like and particularly for effecting recording by ejecting a toner as a developer onto a recording sheet.

2. Background Art

As the capabilities of personal computers have increased in recent years, a large quantity of documents are handled in offices, while a copier, a facsimile, and a printer having high processing abilities have been used widely due to the advancement of network technology. On the other hand, color documents tend to increase because of rapid prevalence of an inkjet printer and the like. However, an engine capable of outputting monochrome and color documents which are satisfactory both in printing speed and in image quality is still under development, so that the advent of such an engine as mentioned above is expected in this field.

As a conventional image forming apparatus, there is one using a direct marking method wherein an image is formed directly on paper. For example, the image forming apparatus disclosed in Japanese Unexamined Patent Publication No. SHO 63-136058 is aproposal of an apparatus of toner ejection type which is one of direct marking methods.

Below, an example of the foregoing conventional image forming apparatus will be described with reference to the appended drawings.

FIG. 17 is a sectional view showing a schematic structure of the conventional image forming apparatus. In FIG. 17, a toner 105 as a developer is filled in a developer hopper 104, and the toner 105 is guided to the position of a toner layer regulating blade 103 in contact with a toner transport roller 101 by the rotating action of a toner supply roller 102 and of the toner transport roller 101.

As shown in FIG. 17, a flexible printed circuit 110 is disposed under the developer hopper 104 in such a manner as to cover an opening 104*a*. A backside electrode 111 is provided in opposing relation to the flexible printed circuit 110. A direct-current power source 112 is connected to the backside electrode 111. In the structure, a recording sheet 122 from a sheet supply roller 120 passes over the backside electrode 111 to be guided to a heat roller 123.

FIG. 18 is a detailed diagram showing, under magnification, a part of the flexible printed circuit 110 of FIG. 17. In FIG. 18, part (a) is a vertical sectional view of the flexible printed circuit 110 and part (b) is a plan view of the flexible printed circuit 110 when viewed from the toner transport roller 101. It is to be noted that the part (a) of FIG. 18 is a sectional view taken along the line A–A' of the part (b) of FIG. 18.

As shown in the part (a) of FIG. 18, the flexible printed circuit 110 has image signal electrodes 115 provided on the top surface (surface opposed to the toner transport roller 101) of a flexible printed circuit base 110*a*. The image signal electrodes 115 are provided in such ring-shaped configurations as to surround the top-face openings of apertures 116 which are through holes formed in the flexible circuit base 110*a*, and are electrically connected to signal voltage control means 117.

As shown in the part (b) of FIG. 18, the flexible printed circuit 110 has the apertures 116 and the image signal electrodes 115 corresponding to the apertures 116 which are arranged in plural numbers along the width of the recording sheet 122 and is disposed such that a line drawing in a direction along the width of the recording sheet 22 is formed.

Next, a description will be given on the operation of the conventional image forming apparatus thus constituted.

As shown in FIG. 17, the toner 105 is supplied from the toner supply roller 102 to the toner transport roller 101 which is grounded and the toner 105 is formed into a thin layer having a uniform film thickness by the toner layer regulating blade 103. The thin-layer toner 105 thus formed is a non-magnetic material having an amount of charge of −10 $\mu$/g and an average particle diameter of 8 $\mu$m.

The toner layer formed on the outer circumferential surface of the toner transport roller 101 is transported to a proximate position at a distance of about 30 $\mu$m from the image signal electrodes 115 (the part (a) of FIG. 18) of the flexible printed circuit 110. At this time, when a voltage of +300 V is applied to the image signal electrodes 115 by the image signal voltage control means 117, the toner 105 passes through the apertures 116 and jumps in the direction of the recording sheet 122. A voltage of +1000 V is applied to the backside electrode 111 and the toner 105 that has jumped is attracted to the backside electrode 111 to land on the recording sheet 122, thereby forming dots.

If the voltage to the image signal electrodes 115 is switched to 0 V, the jumping of the toner 105 from the toner transport roller 101 is suppressed and the landing of the toner 105 on the recording sheet 122 is inhibited, so that non-dot parts (blank) are formed. An image is recorded on the recording sheet 122 by controlling the voltage applied to the image signal electrodes depending on the positions of the apertures 116.

However, the conventional image forming apparatus as described above had the following problems.

If the voltage to the image signal electrodes 115 is switched to 0 V during the non-dot part (the blank) formation, the jumping of the toner 105 from the toner transport roller 101 is suppressed. However, the toner 105 jumping between the image signal electrodes 115 and the recording sheet 122 is scattered to land on the periphery of the dots formed on the recording sheet 122, so that the image formed on the recording sheet 122 is in a fogged state.

Moreover, in the conventional image forming apparatus required the same number of image signal voltage control means 117 for applying the voltage to the image signal electrodes 115 as the corresponding number of image signal electrodes 115. In the case where each of the image signal voltage control means 117 is constituted with a change-over switch, 2560 or more switches are necessary to control the flexible printed circuit 110 which covers, e.g., the transverse length (about 8.53 inches) of A4 size at a recording density of 300 dpi. If the recording density is 600 dpi, 5000 or more switches become necessary.

In developing an image forming apparatus of toner ejection type using the flexible printed circuit 110, therefore, it has been a significant challenge in this field to effect high-density recording with a minimum number of switches in terms of production cost. In the case of thus reducing the number of switches, however, an increase in the complexity of the wiring pattern of the flexible printed circuit 110 may lead to higher cost. To achieve reasonable cost, therefore, the number of switches has to be reduced, while a simpler wiring pattern is used.

SUMMARY OF THE INVENTION

It is an object of the present invention to provide an image forming apparatus and an image forming method which have solved the foregoing challenge. In accordance with this invention, there can be formed homogeneous dots free from fog at an image by optimizing a voltage applied to electrodes for an image signal. It is another object of the present invention to provide an image forming apparatus and an image forming method whereby a stable image resistant to environmental and secular changes is formed at reduced manufacturing cost.

Still another object of the present invention is to provide an image forming apparatus and an image forming method which enable the formation of dots high in density and smaller in diameter. Yet another object of the present invention is to provide an image forming apparatus and an image forming method which enable the modulation of dot density and the changing of dot diameter.

To attain the aforesaid objects, an image forming apparatus according to the present invention comprises:

a developer carrying member for carrying at least a charged developer in an image formation region;

a counter electrode disposed in opposing relation to the developer carrying member in the image formation region and supporting a recording member, a specified voltage being applied to the counter electrode;

an insulating base disposed between the developer carrying member and the counter electrode and having a plurality of openings;

image signal electrodes provided around the respective openings in the insulating base in opposing relation to the developer carrying member, an image signal for controlling the amount of developer supplied from the developer carrying member and passing through the openings being applied to the image signal electrodes; and a control signal electrode provided on the insulating base in opposing relation to the counter electrode, a voltage always lower than the voltage applied to the image signal electrodes being applied to the control signal electrode when a developer of negative polarity is used and a voltage always higher than the voltage applied to the image signal electrodes being applied to the control signal electrode when a developer of positive polarity is used.

In the image forming apparatus of the present invention thus structured, the control signal electrode to which the voltage is applied is thus provided, so that an electric field for causing the toner to jump to the developer passage holes is stably generated even during dot formation and during non-dot formation. Accordingly, the toner jumping through the apertures between the image signal electrodes and the recording sheet is prevented from landing the periphery of dots on the recording sheet at the moment at which the voltage to the image signal electrodes is switched, so that the image forming apparatus of the present invention enables the formation of homogeneous dots free from fog at the formed image.

An image forming apparatus in another aspect of the present invention comprises:

a developer carrying member for carrying at least a charged developer in an image formation region;

a counter electrode disposed in opposing relation to the developer carrying member in the image formation region and supporting a recording member, a specified voltage being applied to the counter electrode;

an insulating base disposed between the developer carrying member and the counter electrode and having a plurality of openings;

image signal electrodes provided around the respective openings in the insulating base in opposing relation to the developer carrying member, an image signal for controlling the amount of developer supplied from the developer carrying member and passing through the openings being applied to the image signal electrodes; and a control signal electrode provided on the insulating base in opposing relation to the counter electrode, a voltage synchronized with the voltage applied to the image signal electrodes being applied to the control signal electrode, a voltage always lower than the voltage applied to the image signal electrodes being applied to the control signal electrode when a developer of negative polarity is used and a voltage always higher than the voltage applied to the image signal electrodes being applied to the control signal electrode when a developer of positive polarity is used.

In the image forming apparatus of the present invention thus structured, there is provided the control signal electrode to which a voltage synchronized with the voltage applied to the image signal electrodes is applied, so that the ejection of a toner as the developer from the developer passage holes is controlled accurately and an image forming apparatus which forms an image having stable and excellent image quality is provided.

An image forming apparatus in another aspect of the present invention comprises:

a developer carrying member for carrying at least a charged developer in an image formation region;

a counter electrode disposed in opposing relation to the developer carrying member in the image formation region and supporting a recording member, a specified voltage being applied to the counter electrode;

an insulating base disposed between the developer carrying member and the counter electrode and having a plurality of openings;

image signal electrodes provided on the insulating base in opposing relation to the developer carrying member, the image signal electrodes being formed in a plurality of rows to surround the respective openings, the image signal electrodes in different rows being electrically connected to each other to form a plurality of groups, different voltages being applied to the image signal electrodes in different groups during dot formation and during non-dot formation; and control signal electrodes provided on the insulating base in opposing relation to the counter electrode, the control signal electrodes forming groups corresponding to the individual rows of the openings, different voltages being applied to the control signal electrodes in different groups during dot formation and during non-dot formation.

In the image forming apparatus of the present invention thus structured, the divided control signal electrode is provided for each row of apertures in the insulating base, so that rational grouping is performed without complicating a circuit pattern placed on the insulating base and therefore an image forming apparatus of high quality is provided at low cost.

In an image forming apparatus in'still another aspect of the present invention, high-voltage power-source control means for controlling the voltage applied to the control signal electrodes applies a voltage always lower than the voltage applied to the image signal electrodes when a developer of negative polarity is used and applies a voltage always higher than the voltage applied to the image signal electrodes when a developer of positive polarity is used.

In the image forming apparatus of the present invention thus structured, the operation of ejecting a toner as the developer from the same group of developer passage holes is selected by switching the voltage to the control signal electrode and the voltage applied to the image signal electrodes for the same group of developer passage holes is controlled by the same high-voltage power source control means, so that the number of the high-voltage power source control means is reduced significantly and the image forming apparatus is provided at low cost.

An image forming apparatus in yet another aspect of the present invention comprises:

a developer carrying member for carrying at least charged particles in an image formation region;

a counter electrode disposed in opposing relation to the developer carrying member in the image formation region and supporting a recording member, a specified voltage being applied to the counter electrode;

an insulating base disposed between the developer carrying member and the counter electrode and having a plurality of openings;

image signal electrodes provided around the respective openings in the insulating base in opposing relation to the developer carrying member, an image signal for controlling the amount of developer supplied from the developer carrying member and passing through the openings being applied to the image signal electrodes;

a control signal electrode provided on the insulating base in opposing relation to the counter electrode and controlling the behavior of the developer that has passed through the openings;

image signal switching means for applying a continuous variable voltage to the image signal electrodes; and control signal switching means for applying the continuous variable voltage to the control signal electrode.

The image forming apparatus of the present invention thus structured enables the formation of dots which are high in density and small in diameter, the modulation of dot density, and the changing of dot diameter.

An image forming method of the present invention comprises the steps of:

carrying at least a charged developer by using a developer carrying member in an image formation region;

placing a recording member on a counter electrode in opposing relation to the developer carrying member in the image formation region and applying a specified voltage to the counter electrode;

applying a specified image signal to image signal electrodes provided on an insulating base having a plurality of openings and disposed between the developer carrying member and the recording member such that the image signal electrodes surround the respective openings in opposing relation to the developer carrying member and thereby controlling the amount of developer supplied from the developer carrying member and passing through the openings;

applying a specified control signal to a control signal electrode provided on the insulating base in opposing relation to the counter electrode and thereby controlling the behavior of the developer that has passed through the openings; and applying, to the control signal electrode, a voltage always lower than the voltage applied to the image signal electrodes when a developer of negative polarity is used and applying a voltage always higher than the voltage applied to the image signal electrodes when a developer of positive polarity is used.

In the image forming method of the present invention, respective electric fields are formed between the developer carrying member and the image signal electrode and between the control signal electrode and the counter electrode and the jumping of a toner as the developer is controlled with the combined force of the two electric fields, so that control is effected more easily than in accordance with the conventional image forming method and the electric fields to be combined with each other for causing the toner to jump to the developer passage holes are generated stably constantly even during dot formation and during non-dot formation. In accordance with the present invention, therefore, the toner jumping between the image signal electrodes and the control signal electrode at the moment at which the voltage to the image signal electrodes is switched is prevented from landing on the periphery of a dot formed on a recording sheet, so that excellent dot formation is performed.

An image forming method in another aspect of the present invention comprises the steps of:

carrying at least a charged developer by using a developer carrying member in an image formation region;

placing a recording member on a counter electrode in opposing relation to the developer carrying member in the image formation region and applying a specified voltage to the counter electrode;

applying a specified image signal to image signal electrodes provided on an insulating base having a plurality of openings and disposed between the developer carrying member and the recording member such that the image signal electrodes surround the respective openings in opposing relation to the developer carrying member and thereby controlling the amount of developer supplied from the developer carrying member and passing through the openings; and applying a specified control signal to a control signal electrode provided on the insulating base in opposing relation to the counter electrode and thereby controlling the behavior of the developer that has passed through the openings, the control signal applied to the control signal electrode being a repetitive signal synchronized with the image signal applied to the image signal electrodes and shifted in phase from the image signal.

The image forming apparatus of the present invention thus structured enables the formation of dots which are high in density and smaller in diameter, the modulation of dot density, and the changing of dot diameter.

While the novel features of the invention are set forth particularly in the appended claims, the invention, both as to organization and content, will be better understood and appreciated, along with other objects and features thereof, from the following detailed description taken in conjunction with the drawings.

Figure 2:
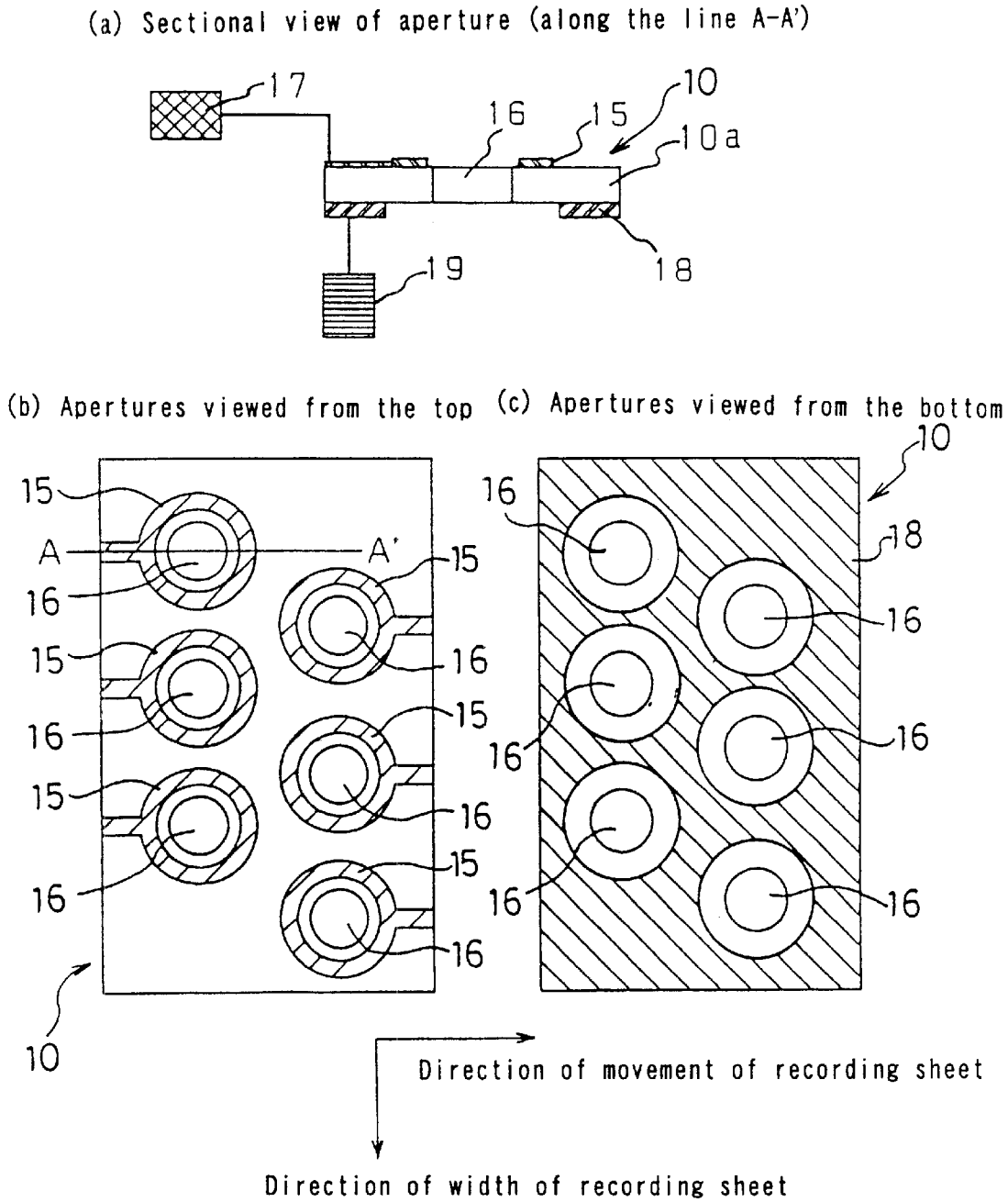
Figure 3:
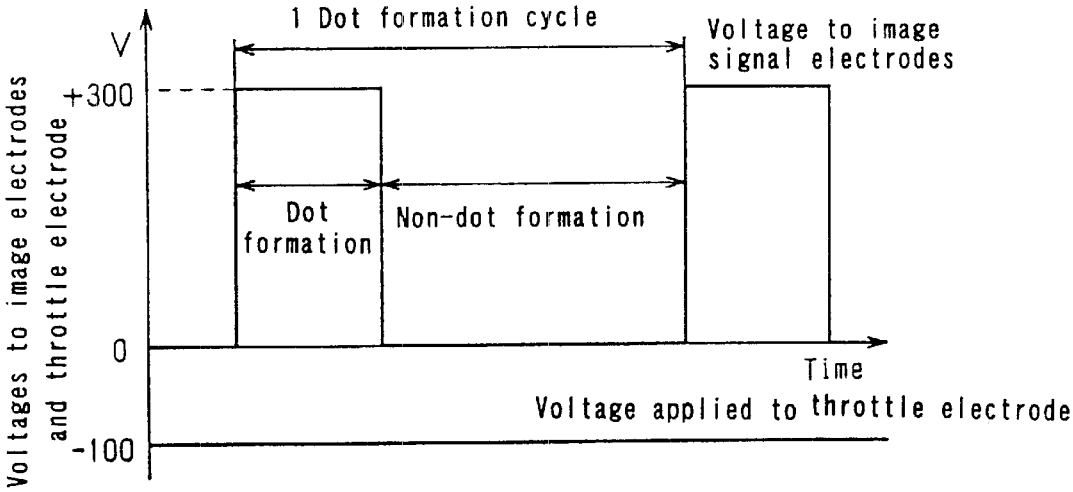
Figure 4:
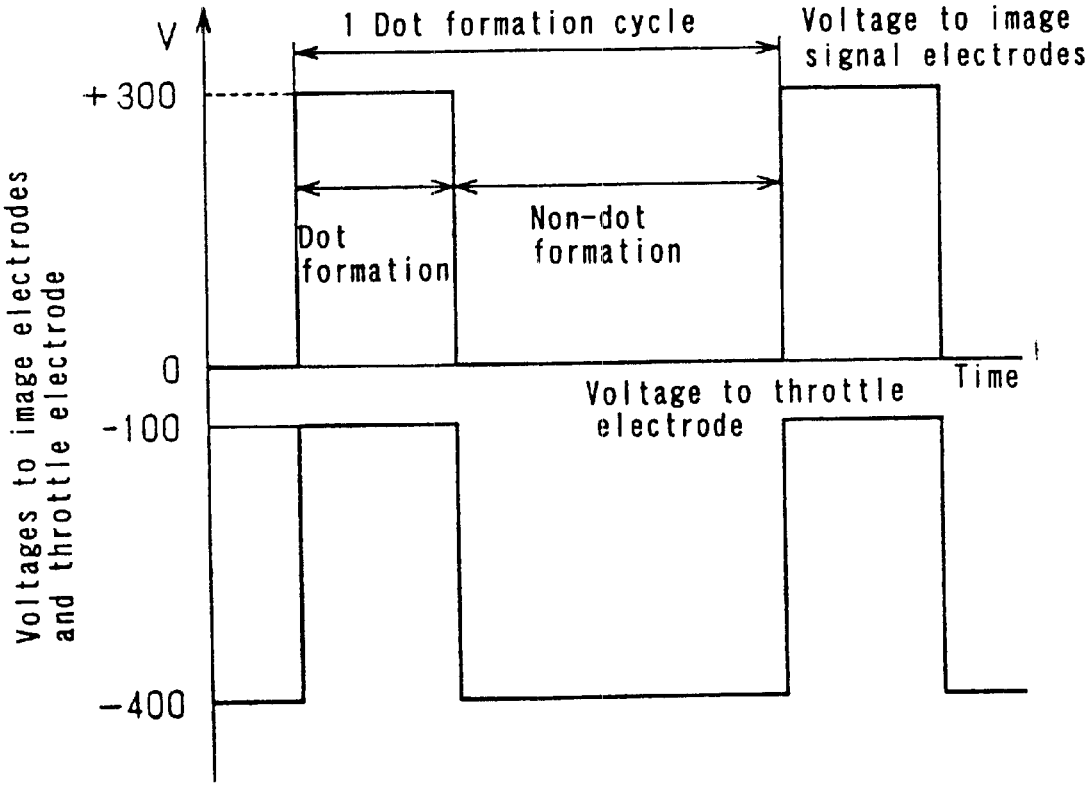
Figure 5:
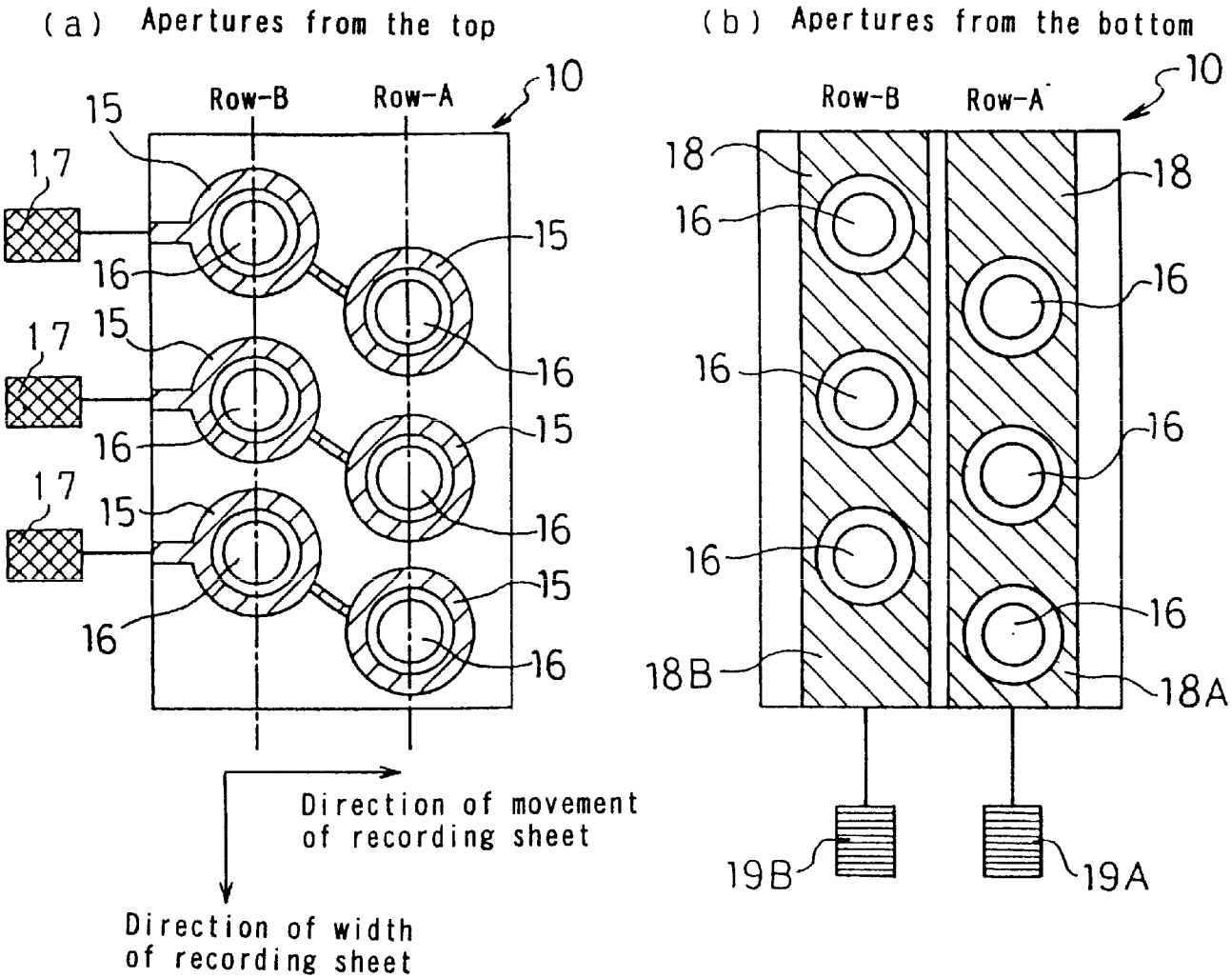
Figure 6:
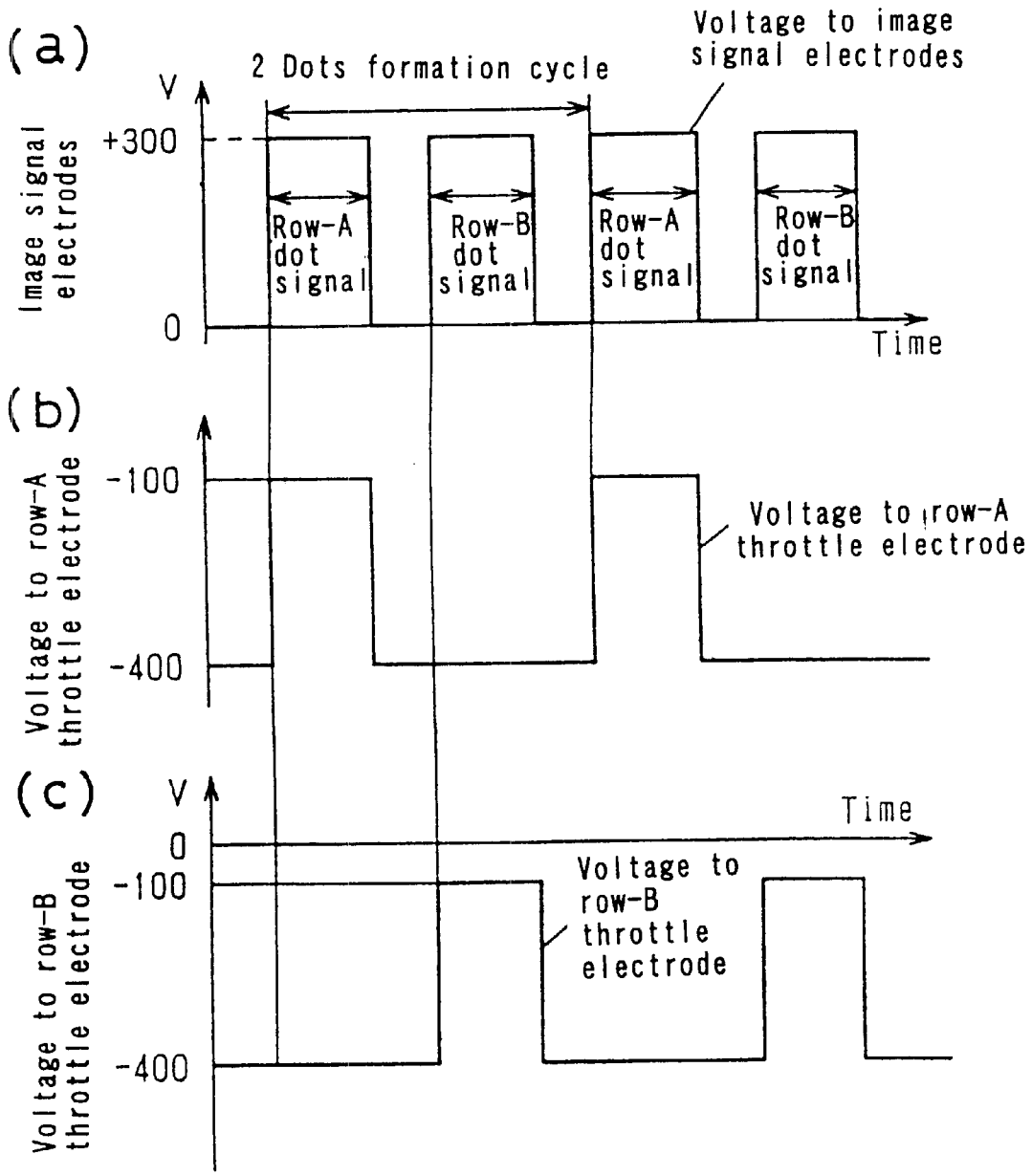
Figure 7:
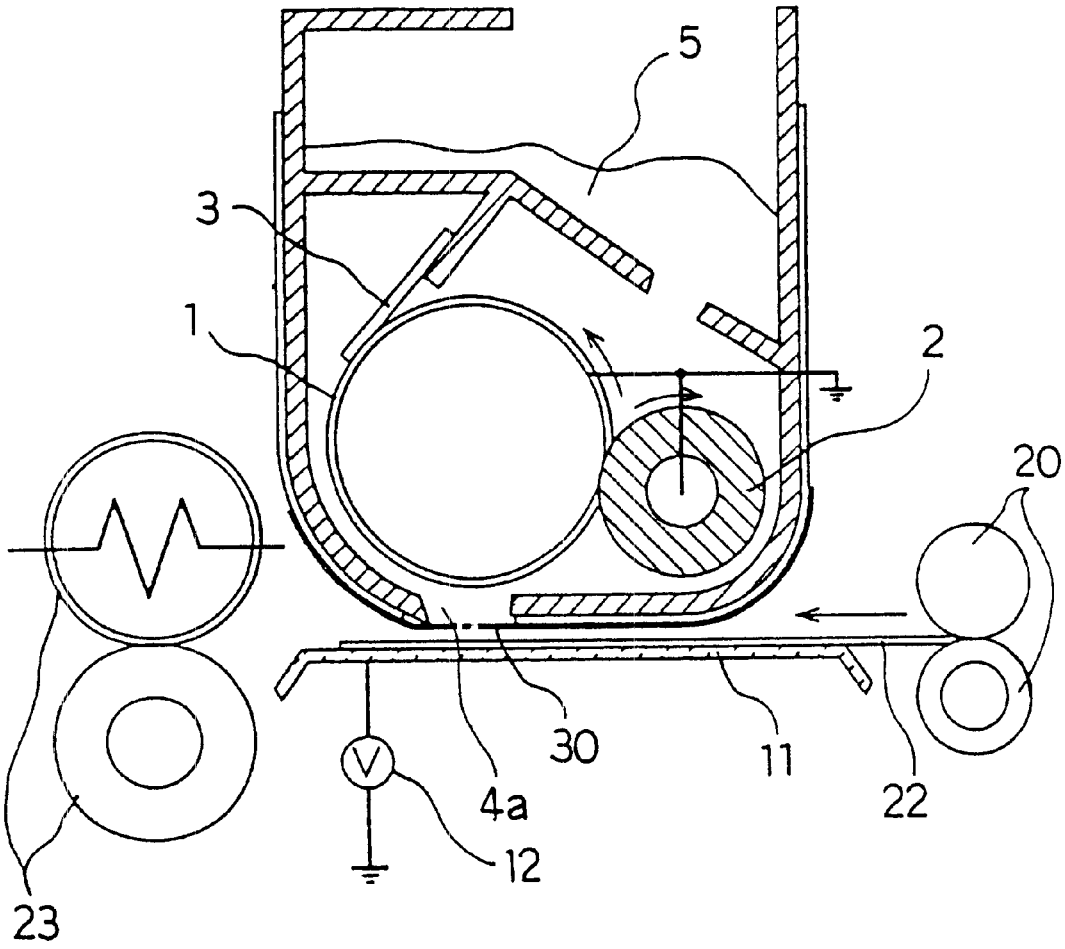
Figure 8:
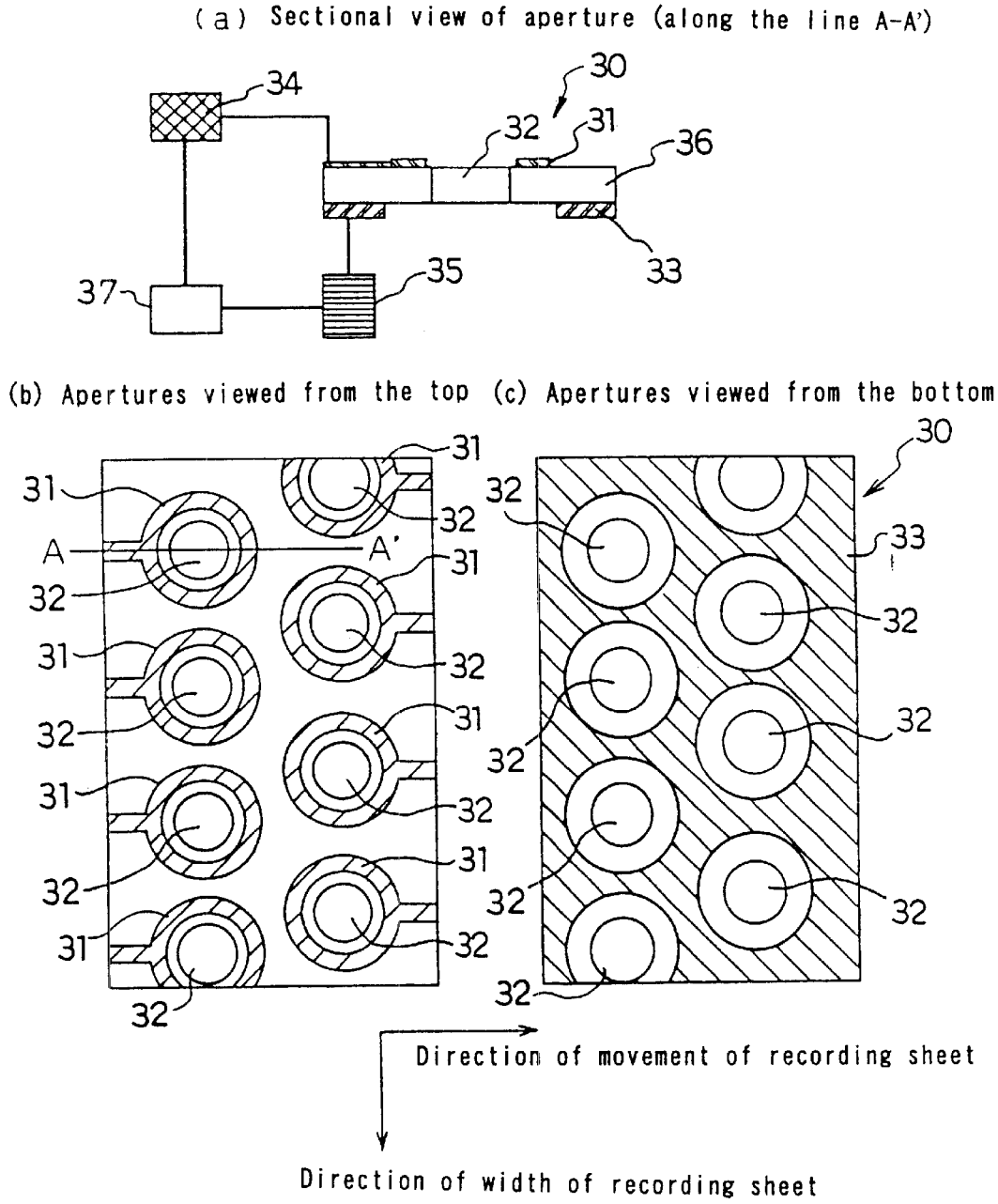
Figure 9:
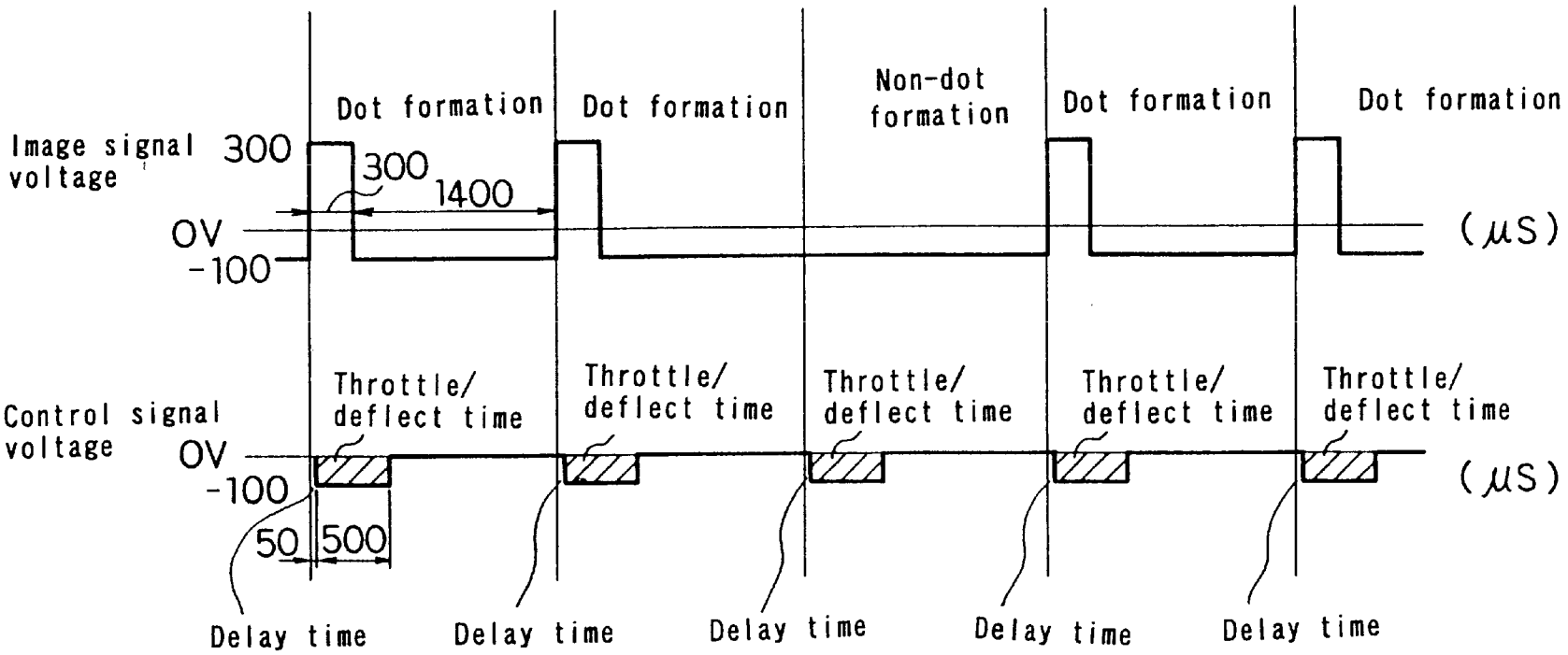
Figure 10:
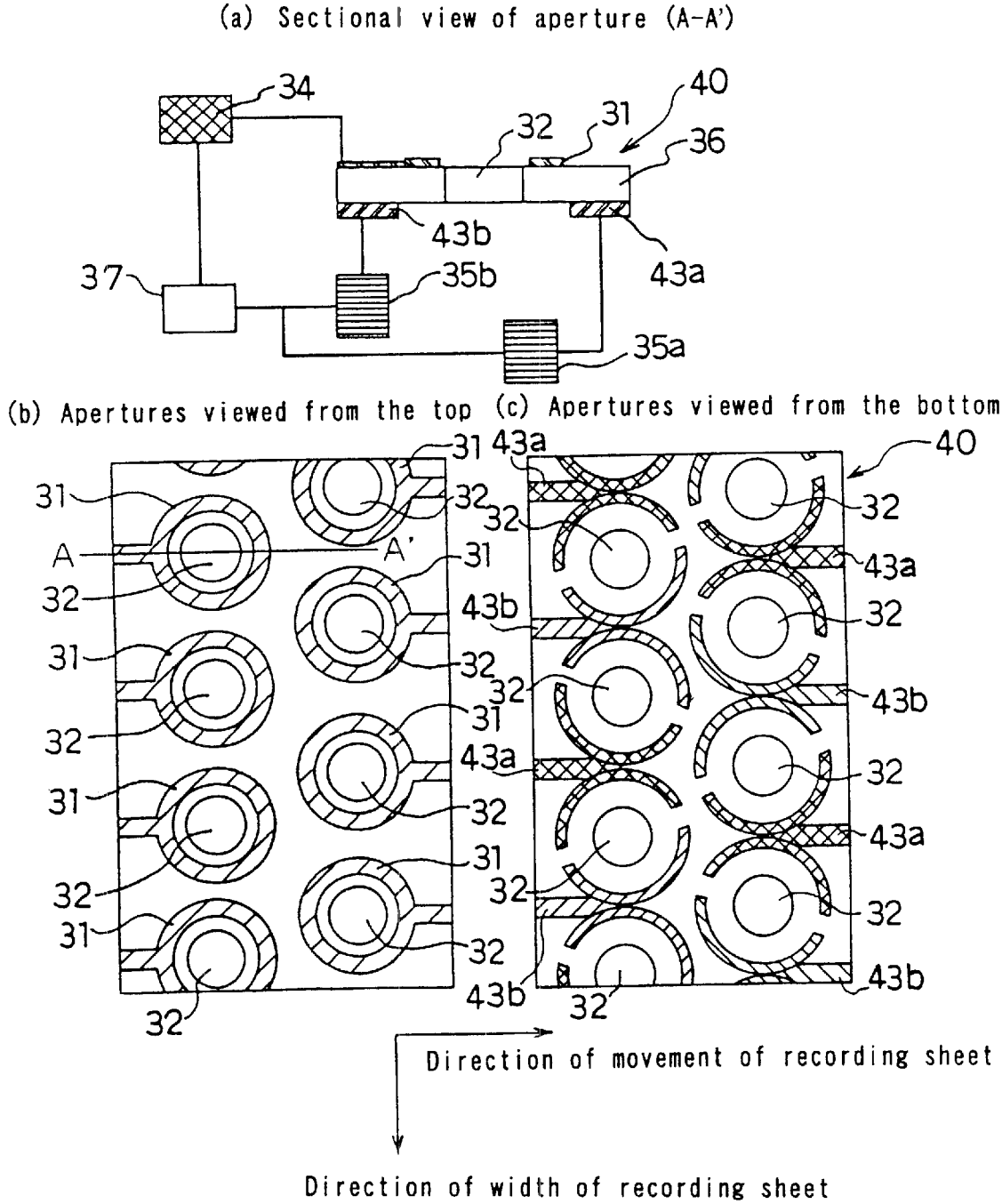
Figure 11:
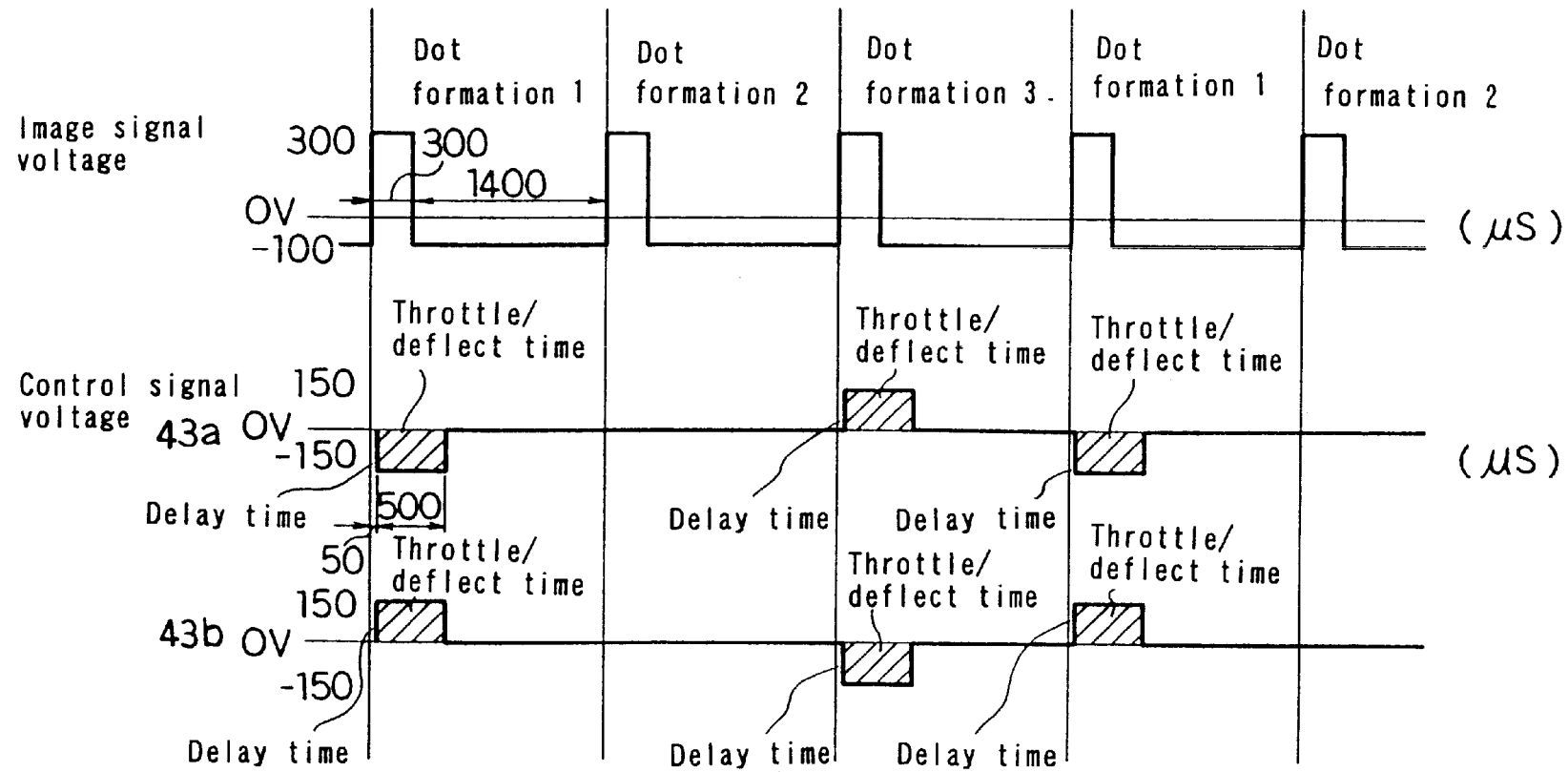
Figure 12:
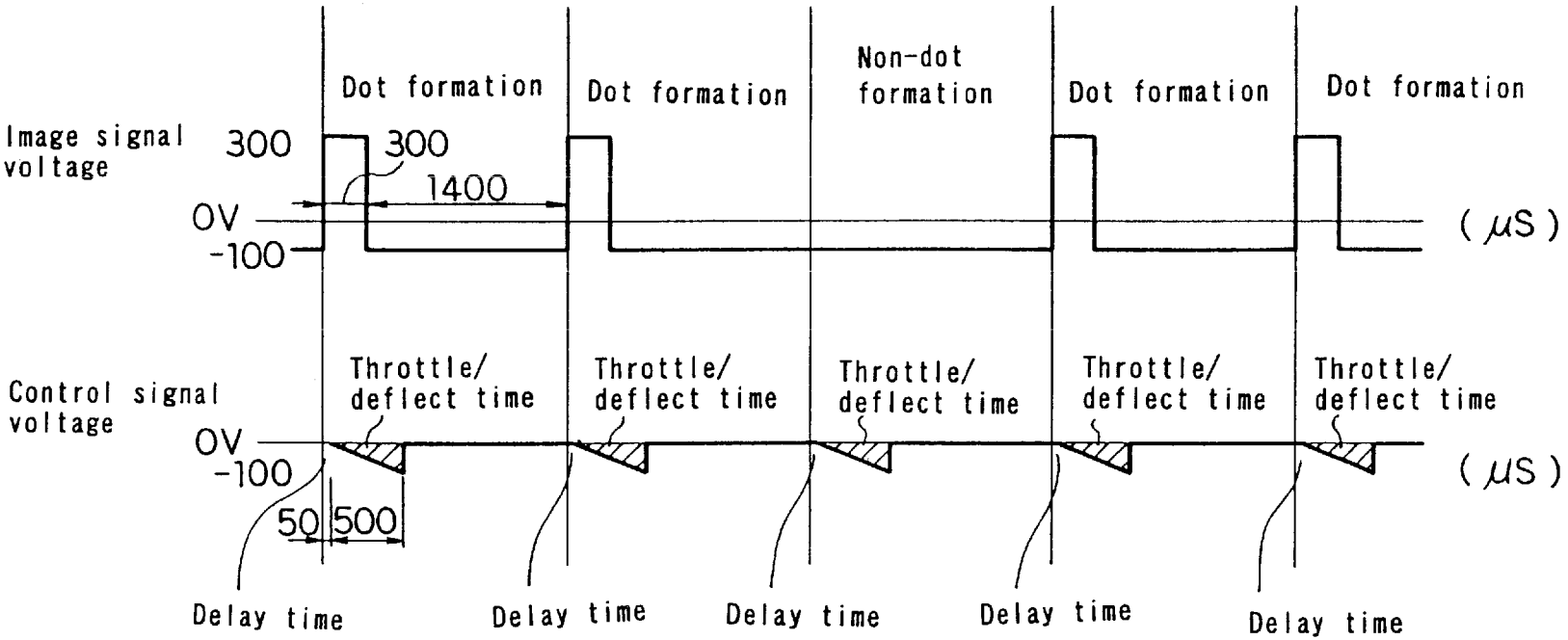
Figure 13:
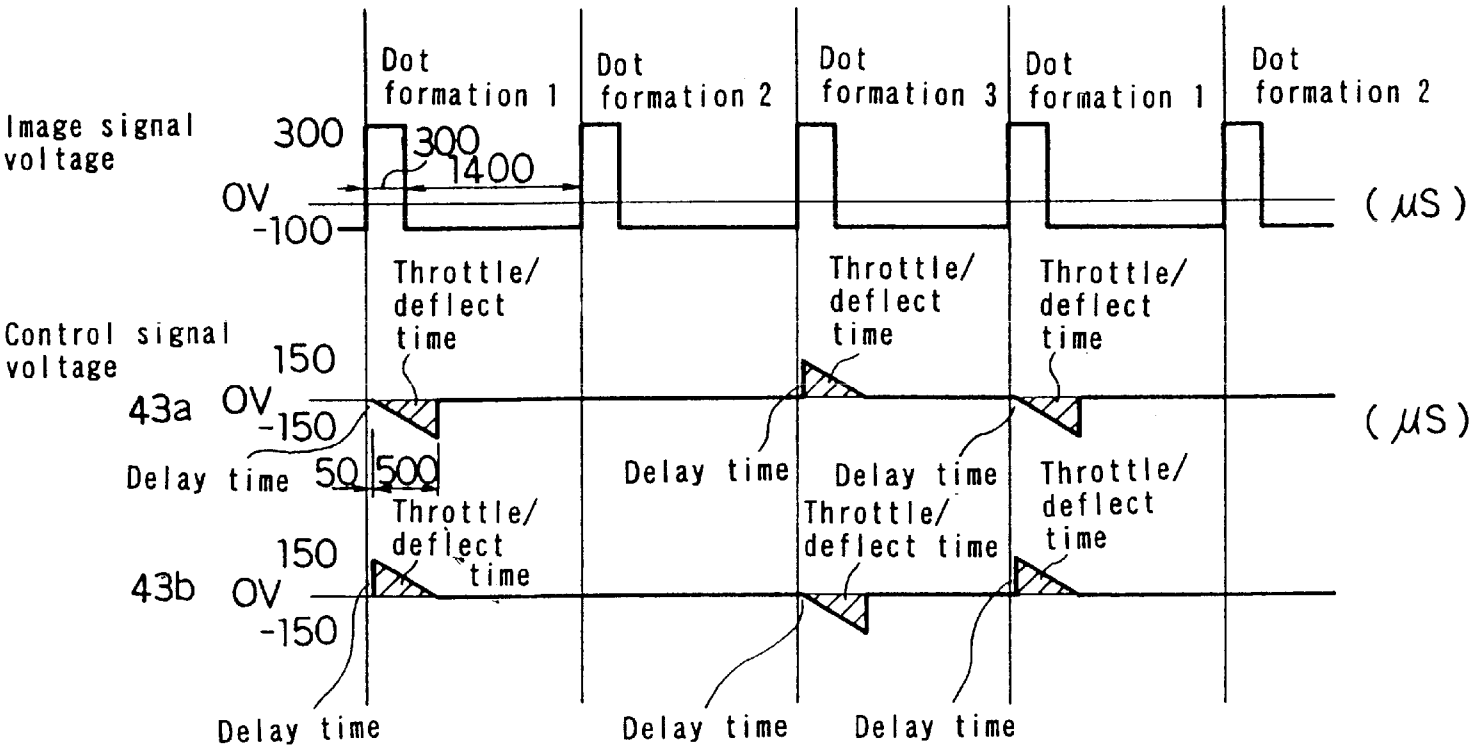
Figure 14:
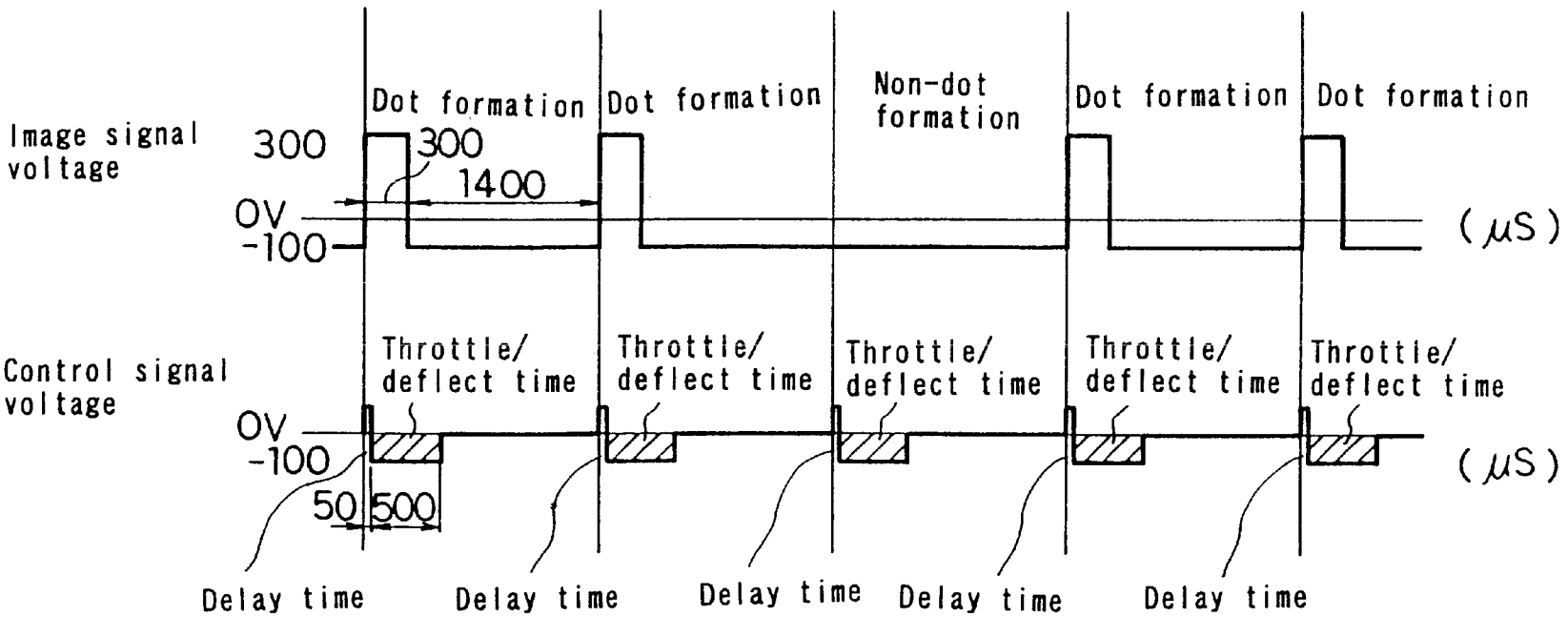
Figure 15:
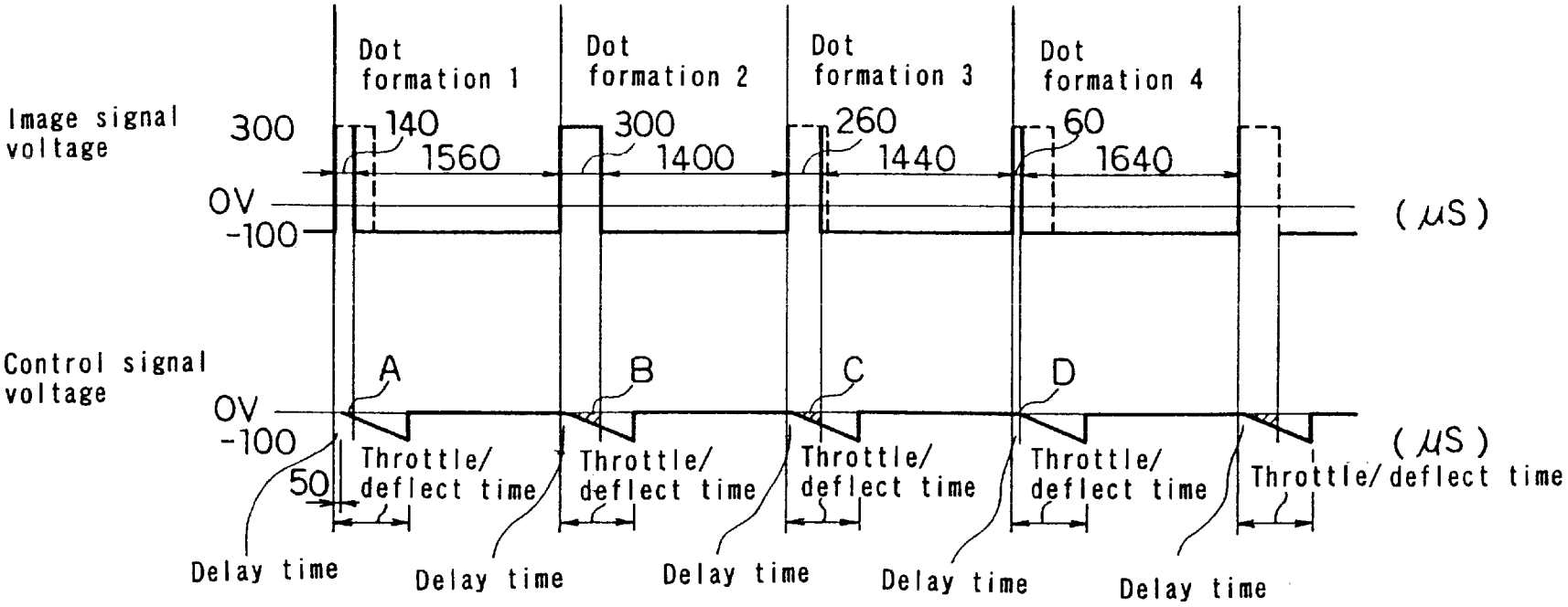
Figure 16:
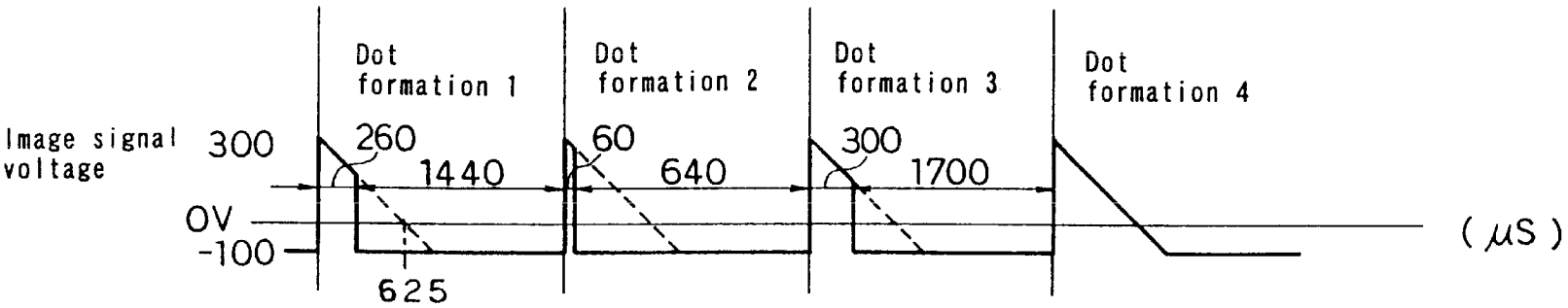
Figure 17:
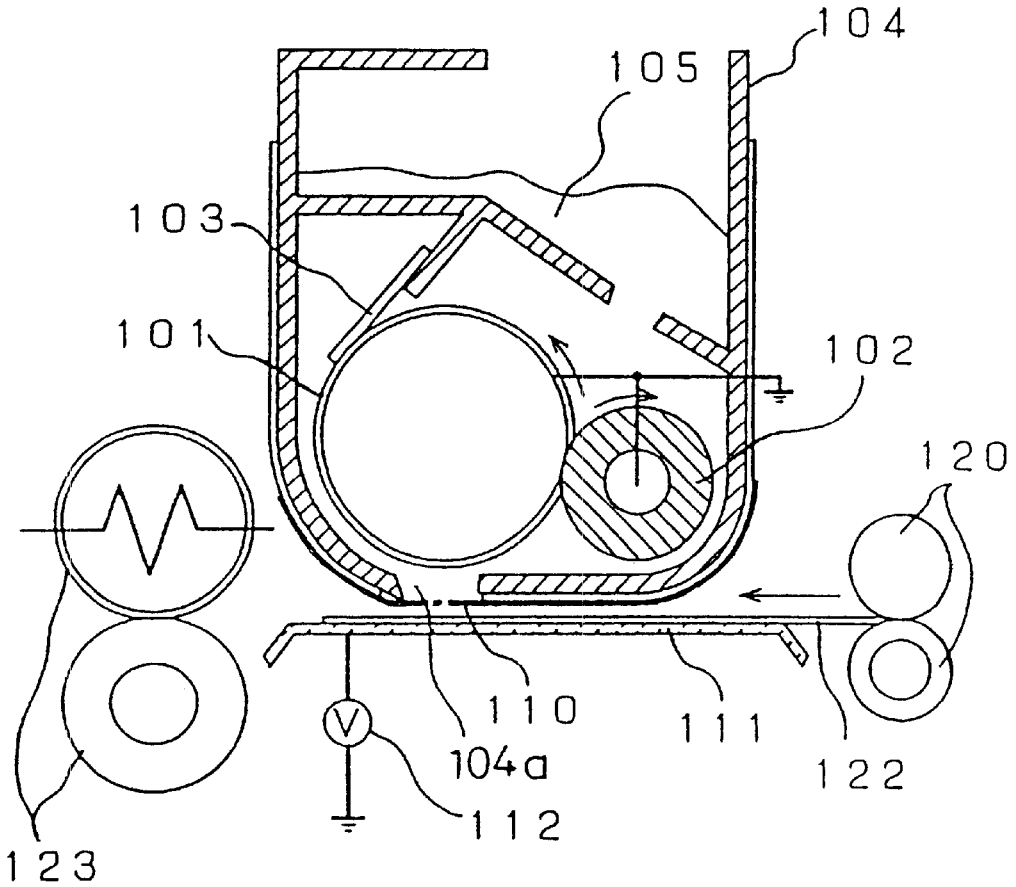
Figure 18:
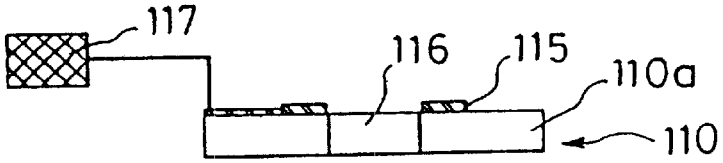
Figure 18:
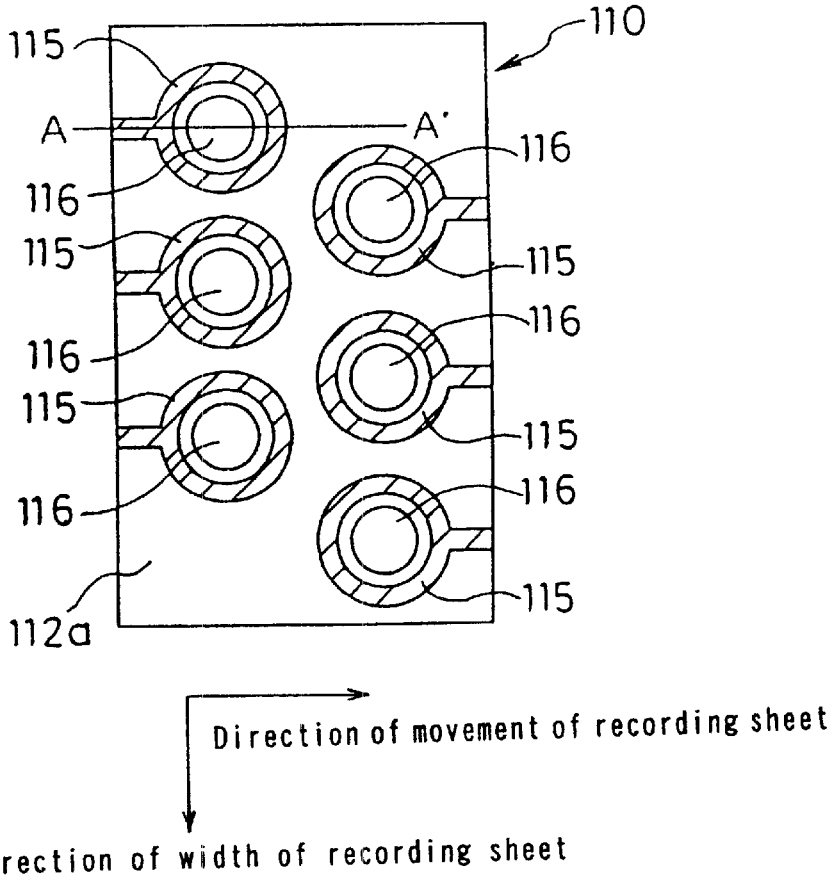

Part (a) of FIG. 2 is a sectional view showing, under magnification, a part of a flexible printed circuit used in the first embodiment of the present invention, part (b) of FIG. 2 is a plan view of the flexible printed circuit, and part (c) of FIG. 2 is a backside view thereof;

FIG. 3 is a waveform chart showing the relationships between respective voltages applied to image signal electrodes and to a throttle electrode and respective application times in the image forming apparatus of the first embodiment;

FIG. 4 is a waveform chart showing the relationships between respective voltages applied to image signal electrodes and to a throttle electrode and respective application times in a second embodiment of the image forming apparatus of the present invention;

part (a) of FIG. 5 is a plan view showing a part of a flexible printed circuit used in a third embodiment of the image forming apparatus of the present invention and part (b) of FIG. 5 is a backside view thereof;

FIG. 6 is a waveform chart showing the relationships between respective voltages applied to image signal electrodes and to a throttle electrode and respective application times in the image forming apparatus of the third embodiment;

FIG. 7 is a schematic structural view of an image forming apparatus in a fourth embodiment of the present invention;

FIG. 8 is an enlarged detailed diagram of a flexible printed circuit used in the fourth embodiment of the present invention;

FIG. 9 is a waveform chart showing the relationships between respective voltages applied to image signal electrodes and to a control signal electrode and respective application times in an image forming apparatus in a fifth embodiment of the present invention;

part (a) of FIG. 10 is a sectional view showing, under magnification, a part of a flexible printed circuit used in a sixth embodiment of the present invention, part (b) of FIG. 10 is a plan view of the flexible printed circuit, and part (c) of FIG. 10 is a backside view thereof;

FIG. 11 is a waveform chart showing the relationships between respective voltages applied to image signal electrodes and to a control signal electrode and respective application times in an image forming apparatus of the sixth embodiment of the present invention;

FIG. 12 is a waveform chart showing the relationships between respective voltages applied to image signal electrodes and to a control signal electrode and respective application times in an image forming apparatus of a seventh embodiment of the present invention;

FIG. 13 is a waveform chart showing the relationships between respective voltages applied to image signal electrodes and to a control signal electrode and respective application times in an image forming apparatus of an eighth embodiment of the present invention;

FIG. 14 is a waveform chart showing the relationships between respective voltages applied to image signal electrodes and to a control signal electrode and respective application times in an image forming apparatus of a ninth embodiment of the present invention;

FIG. 15 is a waveform chart showing the relationships between respective voltages applied to image signal electrodes and to a control signal electrode and respective application times In an image forming apparatus of a tenth embodiment of the present invention;

FIG. 16 is a waveform chart showing the relationships between respective voltages applied to image signal electrodes and to a control signal electrode and respective application times in another image forming apparatus of the tenth embodiment of the present invention;

FIG. 17 is a sectional view showing a schematic structure of a conventional image forming apparatus; and the part (a) of FIG. 18 is the sectional view showing, under magnification, a flexible printed circuit used in the conventional image forming apparatus and the part (b) of FIG. 18 is the plan view of the flexible printed circuit.

It is to be noted that the drawings are partly or wholly depicted in general illustrative representations and do not necessarily reflect the relative sizes and positions of actual elements shown therein with perfect fidelity.

DETAILED DESCRIPTION OF THE INVENTION

Next, the preferred embodiments of an image forming method and an image forming apparatus of the present invention will be described with reference to the appended drawings.

First Embodiment

Figure 1:
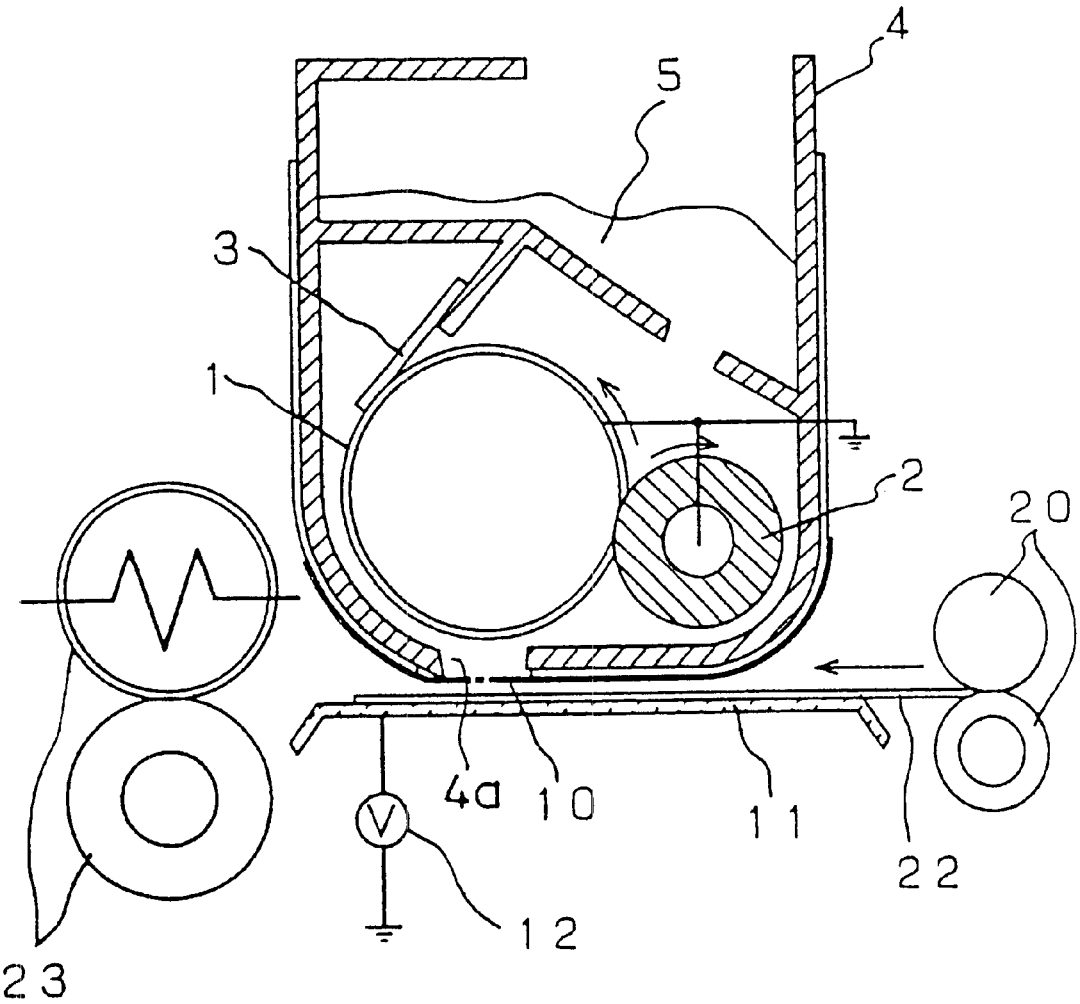
FIG. 1 is a sectional view showing a schematic structure of a first embodiment in an image forming apparatus of the present invention.

Referring to FIGS. 1 to 3, a description will be given below on a first embodiment of the image forming apparatus as the preferred embodiment of the present invention.

FIG. 1 is a sectional view showing a schematic structure in the image forming apparatus of the first embodiment of the present invention. In FIG. 1, a toner 5 as a developer is filled in a developer hopper 4. The toner 5 is guided to the position of a toner layer regulating blade 3 in contact with a toner transport roller 1 as a developer carrying member, by the rotation of a toner supply roller 2 and of the toner transport roller 1. The toner supply roller 2 and the toner transport roller 1 are in contact with each other and rotate in each other opposite directions, and are grounded.

As shown in FIG. 1, an opening 4*a* is formed in the image formation region in the lower part of the developer hopper 4. A flexible printed circuit 10 is disposed in such a manner as to cover the opening 4*a*. A counter electrode 11 as a backside electrode is provided in opposing relation to the flexible printed circuit 10. A direct-current power source 12 is connected to the counter electrode 11. A recording sheet 22 as a recording member is led from a supply roller 20, passing over the counter electrode 11, and guided to a heat roller 23.

FIG. 2 is a detailed diagram showing, under magnification, the flexible printed circuit 10 of FIG. 1. In FIG. 2, part (a) is a vertical sectional view of the flexible printed circuit. And part (b) of FIG. 2 is a plan view of the flexible printed circuit 10 when viewed from the toner transport roller 1. Further, part (c) of FIG. 2 is a backside view of the flexible printed circuit 10 when viewed from the counter electrode 11. It is to be noted that the part (a) of FIG. 2 is a sectional view taken along the line A–A' of the part (b) of FIG. 2.

As shown in the part (a) of FIG. 2, the flexible printed circuit 10 has image signal electrodes 15 provided on the top surface of a flexible printed circuit base 10*a*. On the other hand, a throttle electrode 18 is provided on the back surface of the flexible printed circuit base 10*a*. The image signal electrodes 15 are provided independently in ring-shaped configurations in such a manner as to surround the top-surface openings of a plurality of apertures 16 as through holes which are formed in the flexible circuit base 10*a*. The image signal electrodes 15 are electrically connected to individual signal voltage control means 17, respectively. The apertures 16 have a function as developer passage holes.

On the other hand, the throttle electrode 18 is formed over the entire back surface of the flexible printed circuit base 10*a* and electrically connected to throttle electrode voltage control means 19.

As shown in the part (b) of FIG. 2, the apertures 16 in the flexible printed circuit 10 and the image signal electrodes 15 corresponding to the apertures 16 are arranged in plural numbers along the width of the recording sheet 22. The image signal electrodes 15 are disposed such that a line drawing in a direction along the width of the recording sheet 22 is performed.

In the first embodiment, the flexible printed circuit base 10*a* is formed of a polyimide film having a thickness of 50 μm. Each of the image signal electrodes 15 is in a ring-shaped configuration having an inner diameter of 150 μm and an outer diameter of 250 μm.

The apertures 16 are holes extending through the flexible printed circuit base 10*a*, each of which has a diameter of 145 μm. Each of the holes in the throttle electrodes 18 has an inner diameter of 250 μm.

Next, a description will be given on the operation of the image forming apparatus of the first embodiment thus constituted. The following is the description of the operation in the case where the toner 5 containing charged particles of minus polarity is used. FIG. 3 is a voltage waveform chart showing the relationships between respective voltages applied to the image signal electrodes and to the throttle electrode and respective application times.

As shown-in the above-mentioned FIG. 1, the toner 5 is supplied from the toner supply roller 2 onto the outer circumferential surface of the toner transport roller 1 which is grounded and a thin film of toner 5 is formed on the toner transport roller 1 by the toner layer regulating blade 3. The toner 5 is a non-magnetic material having an amount of charge of −10 μC/g and an average particle diameter of 8 μm.

The toner layer formed on the toner transport roller 1 is transported to the position opposed to the opening 4*a* of the developer hopper 4 and placed at a distance of about 30 μm from the image signal electrodes 15 (the part (a) of FIG. 2) of the flexible printed circuit 10. At this time, when a voltage of +300 V is applied to the image signal electrodes 15 by the image signal voltage control means 17, the toner 5 passes through the apertures 16 and jumps in the direction of the recording sheet 22. Since a voltage of +1000 V is constantly applied to the counter electrode 11, the toner 5 that has flown from the toner transport roller 1 is attracted to the counter electrode 11 to land on the recording sheet 22, thereby forming dots.

Thus, among the toner 5 that has landed on the recording sheet 22, the toner 5 that has jumped through the apertures 16 is collected to the vicinity of the center axes of the apertures 16 by the throttle electrode 18 to which a voltage of −100 V has been applied. This prevents the scattering of the toner 5 when it lands on the recording sheet 22.

If the voltage to the image signal electrodes 15 is switched to 0 V, the jumping of the toner 5 from the toner transport roller 1 is suppressed and the landing of the toner 5 on the recording sheet 22 is inhibited, so that the recording sheet 22 becomes blank. By thus controlling the voltage applied to the image signal electrodes 15, an image is recorded onto the recording sheet 22 depending on the positions of the apertures 16.

In the foregoing image forming operation, the voltage applied to the throttle electrode 18 is set to a value always lower than the voltage applied to the image signal electrodes 15, as shown in FIG. 3. Consequently, an electric field generated between the image signal electrodes 15 and the throttle electrode 18 is constantly acting in a direction along the center axes of the apertures 16. Therefore, the toner 5 floating between the image signal electrodes 15 and the throttle electrode 18 is prevented from being scattered at the moment of switching the voltage to the image signal electrodes 15 from a high value (+300 V) to a low value (0 V), to prevent the jumping of the toner 5 from the toner transport roller 1, which enables the formation of excellent dots.

When dot formation is not performed in the image forming apparatus of the first embodiment, the leakage of the toner 5 from the apertures 16 as the developer passage holes can be prevented by setting the voltage to the throttle electrode 18 to a value of the same polarity as the polarity of the toner 5, which is larger in absolute value than the voltage to the image signal electrodes 15.

When dot formation is performed in the image forming apparatus of the first embodiment, on the other hand, the voltage to the throttle electrode 18 is set to a value of the same polarity as the polarity of the toner 5, which is constantly smaller in absolute value than the voltage to the image signal electrodes 15 or, alternatively, no load is placed on the throttle electrode 18. In this condition, a voltage of the polarity opposite to the polarity of the toner 5 is applied to the image signal electrodes 15, thereby causing the toner 5 to jump toward the counter electrode from the apertures 16. With the use of the throttle electrode 18, the image forming apparatus of the first embodiment can control the ejection of the toner 5 more precisely than the conventional image forming apparatus which controls the ejection of the toner only with the image signal electrodes and enables the formation of an image of more stable quality.

Although the description has been given to the case where recording is effected directly onto the recording sheet 22 with the toner 5 in the image forming apparatus of the first embodiment, the image forming apparatus can be constructed similarly and operates in the case of effecting recording onto a middle transfer member.

Second Embodiment

Next, a second embodiment of the image forming apparatus of the present invention will be described. The basic structure of the image forming apparatus of the second embodiment is the same as that of the image forming apparatus of the foregoing first embodiment, and the description will be given only on different portions. In the following description, the same reference numerals are assigned to the same components having the same structures and functions as in the image forming apparatus of the first embodiment. FIG. 4 is a graph showing the relationships between respective voltages applied to image signal electrodes 15 and to a throttle electrode 18 and respective application times.

As shown in FIG. 4, a voltage to the throttle electrode in the second embodiment is of rectangular wave synchronized with the image signal, and the low value of the voltage applied to the throttle electrode 18 has been set to −400 V. When the voltage applied to the throttle electrode 18 has a value of −400 V, a repulsive electric field is generated adjacent the apertures 16, which prevents the toner 5 from leaking from the apertures 16.

In the case of forming dots on the recording sheet 22, the voltage to the throttle electrode 18 is switched to −100 V with the timing of forming dots such that the toner 5 is controlled to pass through the apertures 16. At this time, a voltage of +300 V is applied to the image signal electrodes 15 to cause the toner 5, to jump from the toner transport roller 1. As a result, the toner 5 passes through the apertures 16 to land on the recording sheet 22, thereby forming dots.

By thus controlling the image signal electrodes 15 and the throttle electrode 8, the ejection of the toner 5 can be controlled more precisely than in the first image forming apparatus which controls the jumping of the toner 5 only by controlling the voltage to the image signal electrodes 15, so that an image forming apparatus which forms an image of more stable and excellent quality is provided.

Although the waveform of the voltage to the throttle electrode 18 has been rectangular in the foregoing second embodiment, even a triangular wave or sawtooth wave can achieve the same effect as achieved in the second embodiment.

Although the second embodiment has described the case where recording is effected directly onto the recording paper 22 with the toner 5, the present invention is similarly applicable to the case where the toner 5 is recorded onto a middle transfer member.

Third Embodiment

Next, a third embodiment of the image forming apparatus'of the present invention will be described. The basic structure of the image forming apparatus of the third embodiment is the same as that of the image forming apparatus of the foregoing second embodiment, so that the description will be given only on different portions. In the following description, the same reference numerals are assigned to the same components having the same structures and functions as in the image forming apparatus of the first and second embodiments.

FIG. 5 is a detailed view of the flexible printed circuit 10 in the image forming apparatus of the third embodiment. Part (a) of FIG. 5 is a wiring diagram on the image signal electrode side of the flexible printed circuit 10 used in the image forming apparatus of the third embodiment and the part (b) of FIG. 5 is a wiring diagram on the throttle electrode side of the flexible printed circuit 10 used in the image forming apparatus of the third embodiment.

As shown in the part (a) of FIG. 5, of the image signal electrodes 15 of the third embodiment, each diagonally arranged two in different rows are connected to each other, so that the image signal electrodes 15 around the apertures 16 as the developer passage holes are connected in twos to the same image signal control means 17. As shown in the part (b) of FIG. 5, the throttle electrode 18 is divided to correspond to the individual rows (rows A and B) of apertures 16 as the developer passage holes, so that the row-A throttle electrode 18A' and the row-B throttle electrode 18B' are connected to respective independent throttle electrode voltage control means 19A and 19B.

FIG. 6 is a waveform chart showing the relationships between respective voltages applied to the image signal electrodes and to the throttle electrodes and respective application times. Part (a) of FIG. 6 is a waveform chart for the voltage to the image signal electrodes 15, part (b) of FIG. 6 is a waveform chart for the voltage to the row-A throttle voltage 18A, and part (c) of FIG. 6 is a waveform chart for the voltage to the row-B throttle voltage 18A.

As shown in the parts (b) and (c) of FIG. 6, the voltage having a value switchable between −400 V and −100 V are applied to the throttle electrode 18 of the third embodiments in synchronization with respective image signals. In the case of applying −400 V to the throttle electrode 18, the toner 5 is prevented from being ejected from the apertures 16 even if a voltage of +300 V is applied to the image signal electrodes 15. However, if a voltage of −100 V is applied to the throttle electrode 18 and a voltage of +300 V is applied to the image signal electrodes 15, the toner 5 jumps from the apertures 16.

In the third embodiment, the image signal electrodes 15 corresponding to the two apertures 16, 16 are connected to one image' signal voltage control means 17, as shown in the part (a) of FIG. 5. The voltages corresponding to the respective image signals are applied sequentially to the image signal electrodes 15 corresponding to the two apertures 16, 16 in synchronization with switching between the voltages to the throttle electrodes 18.

From the apertures 16 in the throttle electrode 18 to which a voltage of −100 V is applied, the toner 5 is ejected in an amount responsive to the time during which the image signal electrodes 15 are at 300 V and lands on the recording sheet 22. Consequently, the toner 5 is ejected from the row-A apertures 16 when a voltage of −100 V is applied to the row-A throttle electrode 18A.

Next, when a voltage of −100 V is applied to the row-B throttle electrode 18B, the toner 5 is ejected from the row-B apertures 16. The ejection from the rows A and B is thus alternately repeated in synchronization with the speed of movement of the recording sheet 22, thereby forming an image.

Since the image forming apparatus is so constituted as to form dots on the recording sheet 22 by combining the voltage applied to the throttle electrode 18 with the voltage applied to the image signal electrodes 15, the image signal voltage control means 17 can be composed of ½ of items composing the image signal voltage control means of the image forming apparatus of the foregoing embodiments.

According to the third embodiment, if the throttle electrode 18 is divided and wired in parallel to the row of developer passage holes in the flexible printed circuit 10, rational grouping can be performed without complicating the pattern placement of the flexible printed circuit 10, so that the flexible printed circuit 10 is implemented at low cost. Although the two apertures 16 form one group in the third embodiment, one group may also be formed of, e.g., four apertures 16. The number of apertures to be assigned to one group is determined appropriately based on the recording speed required and the cost of the flexible printed circuit.

Although the waveform of the voltage to the throttle electrode 18 is rectangular in the foregoing third embodiment, even a triangular wave or sawtooth wave can achieve the same effect as achieved in the second embodiment.

Although the third embodiment has described the case where recording is effected directly on the recording paper 22 with the toner 5, the present invention is similarly applicable to the case where recording is effected on a middle transfer member.

Fourth Embodiment

Next, a fourth embodiment of the image forming apparatus according to the present invention will be described with reference to appended FIGS. 7 and 8.

FIG. 7 is a sectional view showing a schematic structure of the image forming apparatus in the fourth embodiment of the present invention. In FIG. 7, a developing roller 1 as the toner transport roller is charged particle transporting means also serving as a charged particle electrode and transports the toner 5 containing charged particles. The developing roller 1 of the fourth embodiment is formed of an aluminum cylinder having an outer diameter of 20 mm and a thickness of 1 mm. As a material for composing the developing roller 1, a metal such as iron or an alloy can be used instead of aluminum. Although the developing roller 1 is constituted to be grounded in the fourth embodiment, the present invention is not limited thereto but a direct-current voltage or an alternate-current voltage may also be applied to the developing roller 1.

A toner layer regulating blade 3 is composed of an elastic member of preferably urethane or the like material and preferably has that a hardness is 40 to 80 degrees (JIS K6301 A scale), its length to a free end (length of the portion protruding from a mounting portion) is 5 to 15 mm, and-a linear pressure is 5 to 40 g/cm to the developing roller 1. Toner 5 is formed in one to three layers on the developing roller 1 of the fourth embodiment. Although the toner layer regulating blade 3 of the fourth embodiment is used in an electrically floating state, the toner layer regulating blade 3 may also be used in a grounded state or with the application of a direct-current voltage or an alternate-current voltage. The toner 5 is sandwiched between the developing roller 1 and the toner layer regulating blade 3, undergoes a small extent agitation therebetween, and receives charge from the developing roller 1 to be charged. In the fourth embodiment, a non-magnetic material having negative charge of −10 $\mu$C/g and an average particle diameter of 8 gm was used as the toner 5. A toner supply roller 2 has a synthetic rubber such as a foaming urethane formed to a thickness on the order of 2 to 6 mm on a metal shaft (having a diameter of 8 mm in the fourth embodiment) of preferably iron, etc, the hardness of which is 30 degrees (machined in the form of a roller and measured by a method in accordance with JIS (Japanese Industrial Standard) K6301 A scale). The amount of bite into the developing roller 1 is preferably on the order of 0.1 to 2 mm. The toner supply roller 2 is used in the grounded state or with the application of a direct-current voltage or an alternate-current voltage and assists the charging of the toner 5, while controlling the supply of the toner.

A counter electrode 11 forms an electric field between the development roller 1 and itself, and it is formed by using a film having a conductive filler dispersed in a metal plate or resin. The resistance of the film is preferably on the order of $10^2$ to $10^{10}$ Ω cm. Although it is preferred to apply a direct-current voltage on the order of 500 to 2000 V to the counter electrode 11 by using a direct-current power source 12, a voltage of 100 V is applied thereto in the fourth embodiment. As a recording method, the toner 5 may be adhered directly onto the counter electrode 11 or, as shown in FIG. 7, the toner 5 may be adhered onto the recording sheet 2 which is placed on the counter electrode 11. In the case of adhering the toner 5 onto the recording sheet 22, sheet feeding is performed by the sheet supply roller 20 and, after the toner is adhered, fixation is performed by a heat roller 23 as fixing roller. It is also possible to form the opposing electrode 11 into an endless film, effecting direct recording on the film, and then transfer the image onto the recording sheet 22. In the fourth embodiment, the speed of sheet feeding is adjusted to 50 mm/s.

FIG. 8 is a diagram showing a schematic structure of a flexible printed circuit 30, of which part (a) of FIG. 8 is a sectional view of the flexible printed circuit 30 and the part (b) of FIG. 2 is a plan view of the flexible printed circuit 30 seen from the developing roller 1, and the part (c) of FIG. 2 is a backside view of the flexible printed circuit 30 seen from the counter electrode 11.

It is to be noted that, in the parts (b) and (c) of FIG. 2, the right-to-left direction in the drawings is the direction of movement of the recording sheet 22 and the vertical direction in the drawings indicates the direction of the width of the recording sheet 22.

As shown in FIG. 8, image signal electrodes 31 of the fourth embodiment are formed in such ring-shaped configurations as to surround respective apertures 32. Although the image signal electrodes 31 of the fourth embodiment are formed to surround the respective apertures 32, the image signal electrodes 31 of the present invention are not limited thereto but may be formed on the inner walls of the respective apertures 32. In the fourth embodiment, an electrode having a ring-shaped configuration with an inner diameter of 150 $\mu$m and an outer diameter of 250 $\mu$m is used as each of the image signal electrodes 31. As shown in the part (a) of FIG. 8, a control signal electrodes 33 on the back side are disposed in non-overlapping relation with the image signal electrodes 31 on the front side.

The control signal electrodes 33 of the fourth embodiment has an inner diameter of 250 $\mu$m. Moreover, a thin resin layer of 1 to 2 $\mu$m (not shown) is formed on each surface of the image signal electrodes 31 and the control signal electrode 33. An insulating film 16 as the base material of the flexible printed circuit preferably has a thickness of 10 to 100 $\mu$m and is preferably formed of an insulating material such as polyimide or polyethylene terephthalate. In the fourth embodiment, the insulating film 16 is formed by using polyimide having a thickness of 50 $\mu$m.

Although in part (b) of FIG. 8 the plurality of apertures 32 are shown with distances in each other spaced relation, in actual configuration, a plurality of apertures 32 are disposed adjacent to each other in a staggered arrangement for mutual interpolation such that a completely black image can be formed when recording is effected on the recording sheet 22 by ejecting the toner 5 from all the apertures 32. Although each of the apertures 32 in the fourth embodiment is formed to have a diameter of 145 $\mu$m, the diameter of each of the apertures 32 is preferably in the range of 50 to 200 $\mu$m.

Each of the image signal electrodes 31 is formed of a conductive metal such as copper and preferably has a thickness of 5 to 30 $\mu$m. The individual image signal electrodes 31 are connected independently to an image signal power source 34 as image signal voltage switching means via a lead line. In the fourth embodiment, a device for generating a continuously varying voltage is used as the image signal power source 34. The control signal electrode 33 is connected to the control signal power source 35 as control signal voltage switching means through a lead line. In the fourth embodiment, a device for generating a continuously varying voltage is used as the control signal power source 35. In the fourth embodiment, phase control means 37 is further provided between the image signal power source 34 and the control signal power source 35 to control the respective phases of the image signal voltage and the control signal voltage.

Although a voltage of 400 V or lower is normally applied to the image signal electrodes 31, in the fourth embodiment a voltage of 300 V is applied during dot formation and a voltage of −100 V is applied during non-dot formation, unless otherwise specified. Although a voltage in the range of −100 to 200 V is normally applied to the control signal electrode 33, in the fourth embodiment a voltage of −100 V is applied unless otherwise specified.

Although the distance between the counter electrode 11 and the flexible printed circuit 30 has been adjusted to 250

μm in the fourth embodiment, the distance is appropriate as long as it is in the range of 50 to 1000 μm. Although the distance between the toner layer on the developing roller 1 and the flexible printed circuit 30 has been adjusted to 50 μm in the fourth embodiment, the distance is appropriate as long as it is in the range of 0 to 200 μm.

In the image forming apparatus of the fourth embodiment thus constituted, when a voltage equal to or higher than a specified value is applied to the image signal electrodes 31 in response to a signal from the outside, the electric field formed between the developing roller 1 and the counter electrode 11 is exposed or an electric field is formed between the developing roller 1 and the image signal electrode 31, so that the toner 5 is attracted directly or indirectly in the direction of the counter electrode 11 by these fields, and the toner 5 is shot onto the recording sheet 22. At this time, the points of impact of the toner 5 on the recording sheet 22 are controlled by applying a desired voltage to the control signal electrode 33.

In the case of using the flexible printed circuit 30 shown in FIG. 8, the points of impact of the toner 5 are limited to the central portions of the apertures 32. In the case of using a flexible printed circuit of an embodiment which is illustrated in FIG. 10 and will be described later, the toner 5 is shot at a position shifted (deflected) from the central portion of the apertures 32.

On the other hand, if a voltage equal to or lower than a specified value is applied to the image signal electrodes 31, an electric field formed between the developing roller 1 and the counter electrode 11 is blocked and the toner 5 is prevented from being shot onto the recording sheet 22.

An image thus formed on the recording sheet 22 by the toner 5 is fixed by means for the heat roller 23 and the formed image is fixed reliably on the recording sheet 22.

Fifth Embodiment

Next, an image forming apparatus of a fifth embodiment will be described with reference to FIG. 9.

The image forming apparatus of the fifth embodiment is a more specific representation of the image forming apparatus of the fourth embodiment described above. Accordingly, components having the same function and structure as in the image forming apparatus of the fourth embodiment are assigned the same reference numeral, and their descriptions are omitted.

FIG. 9 is a signal waveform chart showing the relationship between respective voltages applied to an image signal electrode and to a control signal electrode and application times in the fifth embodiment. As shown in FIG. 9, a voltage of 300 V is applied to the image signal electrodes 31 for 300 μs during dot formation. At this time, the time interval between the adjacent dots is determined by a current sheet feeding speed. In the fifth embodiment, the sheet feeding speed is 50 mm/s and the time interval between the dots is approximately 1700 μs.

On the other hand, a voltage of −100 V is applied to the control signal electrode 33 during dot formation. At this time, an applied voltage is shifted in time by about 50 μs as a delay time from the voltage applied to the image signal electrodes 31. At this time, a voltage of −100 V is applied to the control signal electrode 33 for about 500 μs as a throttle-deflect time.

The foregoing delay time is the time that the toner 5 having departed from the developing roller 1 travels a distance of about 40 μm to reach the flexible printed circuit 30 and also a distance of about 50 μm which is the thickness of the flexible printed circuit 30. The throttle-deflect time during which a voltage is applied to the control signal electrode 33 is appropriate if it is about 300 μs or more, which is the time between the passage of the toner 5 through the flexible printed circuit 30 and the shooting of the toner 5 onto the side of the recording sheet 22 facing the counter electrode 11. However, it is necessary to complete the application of the voltage to the control signal electrode 33 by the subsequent dot formation.

The voltage applied to the control signal electrode 33 is applied in such a direction as to weaken the voltage supplied to cause the departure of the toner 5 from the developing roller 1 or the voltage supplied to cause the movement of the toner 5 from the developing roller 1 to the lower end of the flexible printed circuit 30. Therefore, the method which does not involve the application of the voltage to the control signal electrode 33 during the early stage of dot formation allows the voltage (image signal voltage) applied to the image signal electrode 31 to positively act on the toner 5, like in the image forming apparatus of the fifth embodiment of the present invention. This enables the fifth image forming apparatus to form an image with excellent controllability.

Although the delay time is adjusted to 40 μs in the fifth embodiment, the delay time may be shorter than 40 μs, and in such case, the effect of suppressing the weakening of the voltage supplied to cause the departure of the toner 5 from the developing roller 1 is particularly exerted.

Sixth Embodiment

Next, an image forming apparatus of a sixth embodiment will be described with reference to FIGS. 10 and 11. The image forming apparatus of the sixth embodiment is obtained by modifying the structure of a control signal electrode in a flexible printed circuit 40, and, as for the other components, they are the same as in the fourth embodiment described above. Accordingly, components having the same function and structure as in the image forming apparatus of the fourth embodiment are assigned the same reference numeral, and their descriptions are omitted.

FIG. 10 is a diagram showing a schematic structure of the flexible printed circuit 40 used in the case where the points of impact of dots are deflected in the sixth embodiment. Part (a) of FIG. 10 is a sectional view showing the structure of the flexible printed circuit 40, part (b) is a plan view of the flexible printed circuit 40 when viewed from the developing roller 1, and part (c) is a backside view of the printed circuit 40 when viewed from the counter electrode 11. It is to be noted that, in the parts (b) and (c) of FIG. 10, the right-to-left direction in the drawings is the direction of movement of the recording sheet and the vertical direction in the drawings is the direction of the width of the recording sheet.

Since the basic structure of the image forming apparatus of the sixth embodiment is the same as in the fourth embodiment, a description will be given below only on different portions.

As shown in part (c) of FIG. 10, each of control signal electrodes disposed closer to the counter electrode 11 is composed of divided control signal electrodes 43*a*, 43*b* each in the form of a semicircular divided ring. In the sixth embodiment, the angle at which each of the electrodes in a pair of divided control signal electrodes 43*a*, 43*b* (division angle) is 18.4 degrees relative to the direction of movement of the recording sheet. The ring-shaped divided control signal electrodes 43*a*, 43*b* are formed in non-overlapping relation with the image signal electrodes 31 formed on the top side. In the sixth embodiment, each of the divided control signal electrodes 43*a*, 43*b* has an inner diameter of 250 μm and an outer diameter of 300 μm.

As shown in the part (a) of FIG. 10, the divided control signal electrodes 43*a*, 43*b* are connected to different control signal power sources 35*a*, 35*b*.

FIG. 11 is a signal waveform chart showing the relationship between respective voltages applied to the image signal electrodes 31 (image signal voltage) and to the divided control signal electrodes 43 (divided control signal voltage) and application times, which is used in forming dots in the image forming apparatus of the sixth embodiment thus constituted.

In forming dots, a voltage of 300 V is applied to the image signal electrodes 31 for a time of 300 μs similarly to the foregoing fifth embodiment. As shown in FIG. 11, there are the following three combinations of voltages applied to the divided control signal electrodes 43*a*, 43*b*:

(1) The casewhere −150 V is applied to the first divided control signal electrodes 43*a* and +150 V is applied to the second divided control signal electrodes 43*b*, which is shown as dot formation 1 in FIG. 11;

(2) The case where 0 V is applied to each of the first and second divided control signal electrodes 43*a* and 43*b*, which is shown as dot formation 2 in FIG. 11; and (3) The case where +150 V is applied to the first divided control signal electrodes 43*a* and −150 V is applied to the second divided control signal electrodes 43*b*, which is shown as dot formation 3 in FIG. 11.

The foregoing three combinations of voltages are periodically repeated as shown in FIG. 11. The toner 5 negatively charged passes through the apertures 32 and deflects its points of impact on the recording sheet in accordance with a deflection electric field perpendicular to a toner jumping direction, which is generated by the pair of first divided control signal electrode 43*a* and second divided control signal electrode 43*b*.

In the case (1), the toner 5 is shot with a deflection toward the second divided control signal electrodes 43*b*; in the case (2), the toner 5 is shot at centers of respective apertures 32; and in the case (3), the toner 5 is shot with a deflection toward the first divided control signal electrodes 43*a*.

The deflection amount at the points of impact of the toner 5 is dependent on the distance between the flexible printed circuit 40 and the points of impact and the difference between respective voltages applied to the first divided signal electrode 43*a* and second divided signal electrode 43*b*. That is, the deflection amount of dot formation positions is larger as the distance (shooting distance) between the flexible printed circuit 40 and the points of impact is longer, and as the difference between the respective voltages applied to the first divided signal electrode 43*a* and second divided signal electrode 43*b* is larger. By controlling the shooting distance and the voltage difference described above, dots can be formed at three positions from one aperture 32, which enables the formation of a finer image.

In the case of applying voltages to the ring-shaped first divided control signal electrode 43*a* and second divided control signal electrode 43*b* (in the cases of dot formation 1 and dot formation 3) in the sixth embodiment, a shift of about 50 μs was made as a delay to the image signal electrodes 31, and the application time was about 500 μs. The delay time is a time required by the toner 5 departing from the developing roller 1 to travel a distance of about 40 μm to it's reaching the flexible printed circuit 40 and a distance of about 50 μm which is the thickness of the flexible printed circuit 40, similarly to the case of the foregoing fifth embodiment.

The application time which is the throttle-deflect time for the control signal electrodes is appropriate if it is about 300 μm or more, which is the time between the passage of the toner 5 through the flexible printed circuit 40 and the shooting of the toner 5 onto the side of the recording sheet 22 facing the counter electrode 11. However, it is necessary to adjust the application time such that the application of the voltage is completed by the subsequent dot formation.

Since the voltages applied to the first divided control signal electrode 43*a* and second divided control signal electrode 43*b* influence the voltage supplied to cause the departure of the toner 5 from the roller 1 or the voltage supplied to cause the movement of the toner 5 from the developing roller 1 to the lower end of the flexible printed circuit 40, the method used in the sixth embodiment which does not involve the application of the voltages to the ring-shaped first divided control signal electrode 43*a* and second divided control signal electrode 43*b* during the early stage of dot formation enables the formation of an image with excellent controllability, since it allows the image signal voltage to positively act on the toner 5.

Although in the sixth embodiment the delay time is set to 50 μs, the delay time may be shorter than 50 μs and, in that case, the effects of suppressing the weakening of the voltage supplied to cause the departure of the toner 5 from the developing roller 1 and forming an image at high density are particularly exerted.

Seventh Embodiment

Next, an image forming apparatus of a seventh embodiment will be described with reference to FIG. 12. The image forming apparatus of the seventh embodiment is obtained by changing the signal waveforms of voltage signals applied to image signal electrodes and a control signal electrode in a flexible printed circuit and has the same structure as the image forming apparatus of the foregoing fourth embodiment (FIG. 8). Accordingly, components having the same function and structure as in the image forming apparatus of the fourth embodiment are assigned the same reference numeral, and their descriptions are omitted.

FIG. 12 is a signal waveform chart showing the relationship between respective voltages applied to the image signal electrodes 31 (FIG. 8) and to the control signal electrode 33 (FIG. 8) and application times.

In the seventh embodiment, a voltage of 300 V is applied to the image signal electrodes 31 for a time of 300 μs during dot formation, similarly to the foregoing fourth embodiment. In the seventh embodiment, the interval between the times for forming adjacent dots is about 1700 μs.

As shown in FIG. 12, a voltage lagging behind the voltage applied to the image signal electrodes 31 by about 50 μs as a delay time is applied to the control signal electrode 33. Each of the voltages applied to the control signal electrode 33 is a voltage varying linearly from 0 V to −100 V and the application time as a throttle time is about 500 μs. The foregoing delay time and throttle time are determined similarly to the fourth embodiment described above.

As shown in FIG. 12, a repetitive variable voltage which gradually decreases and has a gradually increasing difference from the image signal voltage is applied to the control signal electrode 33 in the seventh embodiment. By thus applying the delayed variable voltage to the control signal electrode 33, the variable voltage is prevented from functioning to weaken the voltage supplied to cause the departure of the toner 5 from the developing roller 1 or the voltage supplied to cause the movement of the toner from the developing roller 1 to the lower end of the flexible printed circuit 30. Accordingly, the image forming apparatus of the seventh embodiment exerts the effect of forming an image at high density with excellent controllability.

Although in the seventh embodiment the linearly varying voltage to the control signal electrode 33 has been applied, it is also possible to apply a curvedly varying voltage. However, the voltage applied to the control signal electrode 33 is preferably a variable voltage having a gradually increasing difference from the image signal voltage.

Since the seventh embodiment is constituted so that the gradually increasing voltage is applied to the control signal electrode 33, it exerts the same effect as the foregoing embodiments without the provision of a delay as time.

Eight Embodiment

Next, an image forming apparatus of an eighth embodiment will be described with reference to FIG. 13. The image forming apparatus of the eighth embodiment is obtained by changing the signal waveforms of voltage signals applied to image signal electrodes and control signal electrodes at the flexible printed circuit and has the same structure as the image forming apparatus of the foregoing sixth embodiment (FIG. 10). Accordingly, components having the same function and structure as in the image forming apparatus of the sixth embodiment are assigned the same reference numeral, and their descriptions are omitted.

FIG. 13 is a voltage waveform chart showing the relationship between respective voltages applied to the image signal electrodes 31 and to ring-shaped divided control signal electrodes and application times in the eighth embodiment. The divided control signal electrodes of the eighth embodiment have the same structure as the divided control signal electrodes 43*a*, 43*b* shown in FIG. 10 and are composed of first divided control signal electrode 43*a* and second divided control signal electrode 43*b*.

In forming dots, a voltage of 300 V was applied to the image signal electrodes 31 for a time of 300 μs, similarly to the foregoing fourth embodiment. The interval between the times for forming adjacent dots is about 1700 μs. There are three combinations of voltages applied to the first divided control signal electrode 43*a* and the second divided control signal electrode 43*b*, similarly to the foregoing sixth embodiment (dot formation 1, dot formation 2, and dot formation 3 in FIG. 13).

As shown in FIG. 13, it is possible to deflect the toner 5 from one aperture 32 in three directions and shoot to land onto the recording sheet by generating three deflecting electric fields which are respectively perpendicular to the toner jumping direction. As a result, the image forming apparatus of the eighth embodiment can form a finer image.

As shown in FIG. 13, a voltage lagging behind the voltage applied to the image signal electrodes 31 by about 50 μs as a delay time is applied to the first divided control signal electrode 43*a* and the second divided control signal electrode 43*b*. Each of the voltages applied to the first divided control signal electrode 43*a* and the second divided control signal electrode 43*b* is a voltage linearly varying from 0 V to −150 V and the application time as a throttle time is about 500 μs. The foregoing delay time and throttle time are determined similarly to the fourth embodiment described above.

As shown in FIG. 13, repetitive variable voltages each of which gradually decreases and has a gradually increasing difference from the image signal voltage are applied to the first divided control signal electrode 43*a* and the second divided control signal electrode 43*b* in the eighth embodiment. By thus applying the delayed variable voltages to the first divided control signal electrode 43*a* and the second divided control signal electrode 43*b*, the variable voltages are prevented from functioning to weaken the voltage supplied to cause the departure of the toner 5 from the developing roller 1 or the voltage supplied to cause the movement of the toner 5 from the developing roller 1 to the lower end of the flexible printed circuit 40. Accordingly, the image forming apparatus of the eighth embodiment exerts the effect of forming an image at high density with excellent controllability.

Although in the eighth embodiment the linearly varying voltages tot he first divided signal electrode 43*a* and the second control divided signal electrode 43*b* have been applied, it is also possible to apply a curvedly varying voltage. However, each of the voltages applied to the first divided control signal electrode 43*a* and the second divided control signal electrode 43*b* is preferably a variable voltage having a gradually increasing difference from the image signal voltage.

Ninth Embodiment

Next, an image forming apparatus of a ninth embodiment will be described with reference to FIG. 14. The image forming apparatus of the ninth embodiment is obtained by changing the signal waveforms of voltage signals applied to image signal electrodes and a control signal electrode at the flexible printed circuit and the structure of the image forming apparatus of the ninth embodiment is the same as that of the image forming apparatus of the foregoing fourth embodiment (FIG. 8). Accordingly, the description of components having the same function and structure as in the image forming apparatus of the fourth embodiment are assigned the same reference numeral, and their descriptions are omitted.

FIG. 14 is a signal waveform chart showing the relationship between respective voltages applied to the image signal electrodes 31 (FIG. 8) and to the control signal electrode 33 (FIG. 8) and application times in the ninth embodiment.

In forming dots in the ninth embodiment, a voltage of 300 V was applied to the image signal electrodes 31 for a time of 300 μs, similarly to the foregoing fourth embodiment. In the ninth embodiment, the interval of times for forming adjacent dots is about 1700 μs.

As shown in FIG. 14, a voltage of +100 V is applied for a time of about 50 μs, to the control signal electrode 33 simultaneously with the application of a voltage to the image signal electrode 31 during the early stage of dot formation equivalent to the delay time in the foregoing fifth embodiment. Subsequently, a voltage of −100 V is applied to the control signal electrode 33 and the application time as a throttle time is about 500 μs. The foregoing application time and throttle time during the early stage of dot formation are determined similarly to the fourth embodiment described above.

In the ninth embodiment, an image can be formed efficiently since the voltage supplied to cause the departure of the toner 5 from the developing roller 1 or the voltage supplied to the toner 5 to cause the movement of the toner 5 from the developing roller 1 to the lower end of the flexible printed circuit 30 is increased by applying, to the control signal electrode 33, a voltage of a polarity coincident with a voltage applied to the image signal electrode 31.

Although the initial application time for the control signal electrode 33 is set to 50 μs in the ninth embodiment, the initial application time may be shorter than 50 μs and, in that case, the effect of intensifying the voltage supplied to cause the departure of the toner 5 from the developing roller 1 is particularly exerted.

Although the voltages applied to the control signal electrode 33 are constant (+100 V and −100 V) during the respective times in the ninth embodiment, they may be varied linearly or non-linearly as in the foregoing seventh embodiment (FIG. 12).

Although the ninth embodiment has been described by using, as an example, the control signal electrode 33 formed in a ring-shaped configuration, similar effects are achieved by using divided control signal electrodes 43*a*, 43*b* as used in the foregoing fifth embodiment.

Tenth Embodiment

Next, a description will be given on an image forming apparatus of a tenth embodiment with reference to FIG. 15. The image forming apparatus of the tenth embodiment is obtained by changing the signal waveforms of voltage signals applied to image signal electrodes and a control signal electrode at the flexible printed circuit and the structure of the image forming apparatus of the tenth embodiment is the same as that of the image forming apparatus of the foregoing fourth embodiment (FIG. 8).

Accordingly, components having the same function and structure as in the image forming apparatus of the fourth embodiment are assigned the same reference numeral, and their descriptions are omitted.

FIG. 15 is a signal waveform chart showing the relationship between respective voltages applied to the image signal electrodes and to the control signal electrode and application times in the tenth embodiment.

During dot formation, a voltage of 300 V is applied to the image signal electrode 31, similarly to the foregoing fourth embodiment. However, the duty ratio of a pulse is modulated in the tenth embodiment.

As shown in FIG. 15, the dot formation time is 140 μs for dot formation 1, 300 μs for dot formation 2, 260 μs for dot formation 3, and 60 μs for dot formation 4. By thus modulating the duty ratio of the pulse, the densities of dots can be changed in accordance with the duty ratio of the pulse.

However, the diameters of dots to be formed cannot be changed by the method of modulating the duty ratio of the pulse. To change the diameters of the dots, a voltage linearly varying from 0 V to −100 V is applied to the control signal electrode 33 and the throttle-deflect time is set to about 500 μs after the delay time of 50 μs.

By thus setting the delay time and the throttle-deflect time for the control signal electrode 33, the diameters of the dots can be changed. In dot formation 11 of FIG. 15, e.g., the toner 5 that has passed through the apertures 32 is throttled with power which corresponds to the area (region indicated by "A" in FIG. 15) determined by the waveform of a voltage (control signal voltage) applied to the control signal electrode 33 and by the dot formation time of 140 μs. The toner 5 is throttled in dot formation 2 with power which corresponds to the area (region indicated by "B" in FIG. 15) determined by the waveform of a control signal voltage and by the dot formation time of 300 μs, throttled in dot formation 3 with power corresponding to the area (region indicated by "C" in FIG. 15) determined by the waveform of the control signal voltage and by the dot formation time of 260 μs, and throttled in dot formation 4 with power corresponding to the area (region indicated by "D" in FIG. 15) determined by the waveform of the control signal voltage and by the dot formation time of 60 μs.

Thus, the image forming apparatus of the tenth embodiment is capable of changing the diameters of dots depending on the amount of toner 5 that has passed through the apertures 32.

Although the voltage linearly varying from 0 V to −100 V has been applied to the control signal electrode in the tenth embodiment, in contrast thereto it is also possible to apply a voltage linearly varying from −100 V to 0 V and, in that case, extremely small dots can be formed if, e.g., the time during which the image signal electrode is applied is reduced since a smaller amount of toner 5 is throttled intensely.

Although the delay time has been set to 50 μs in the tenth embodiment, the delay time may be shorter than 50 μs, and in that case, the effect of intensifying the voltage supplied to cause the departure of the toner from the developing roller 1.

Although the voltage (image signal voltage) applied to the image signal electrode 31 has been held constant during dot formation in the tenth embodiment, the image signal voltage may also be varied as shown in FIG. 16. FIG. 16 is a signalwaveform chart of the image signal voltage applied to the image signal electrode 31.

As shown in FIG. 16, the waveform of the voltage applied to the-image signal electrode 31 has such an inclination as to linearly decrease from 300 V to 0 V during a period of 625 μs. As shown in FIG. 16 shows, e.g., the cases shown are such that the voltage gradually decreases during the period of 260 μs in case of dot formation 1, during the period of 60 μs in case of dot formation 2, and during the period of 300 μs in case of dot formation 3 is applied to the image signal electrode 31 in voltage waveforms. By thus applying the decreasing voltages to the image signal electrode 31, the amount of jumping toner 5 can be controlled depending on the application time and the inclination of the voltage waveform. Accordingly, the image forming apparatus can modulate the densities of dots with higher precision.

Although the tenth embodiment has been described by using, even in an example where the control signal electrode 33 formed in a ring-shaped configuration, similar effects are used like as divided control signal electrode 43*a*, 43*b* as used in the foregoing fifth embodiment, similar effects are achieved.

The image forming apparatus thus constituted and image forming method of the present invention have the following effects.

(1) The occurrence of fog and an extraordinary dot can be prevented by properly controlling the electric field between the image signal electrode and the throttle electrode, and more stable dot formation can be performed by applying an alternating voltage synchronized with an image signal to the throttle electrode.

(2) Since configuration is made such that a plurality of apertures are united into one group and each group is connected to one image signal control means, so that the apertures through which the toner is ejected are switched by switching the voltage applied to the throttle electrode, the manufacturing cost of the image forming apparatus can be reduced significantly and great reducing of the number of image signal control means is possible without impairing image quality.

(3) Dots which are high in density and smaller in diameter can be formed. Moreover, according to the present invention the modulation of dot densities and the changing of dot diameters can be realized, and therefore excellent image quality can be achieved with high controllability.

Although the invention has been described in its preferred form with a certain degree of particularity, and it is understood that the present disclosure may be changed in details of configuration, and the combination and arrangement of elements may be changed without departing from the scope and concept of the invention.

INDUSTRIAL APPLICABILITY

The image forming apparatus and image forming method of the present invention can be used in a copier, facsimile and printer, and in particular, it is an apparatus and method necessary to effect recording on a recording member by ejecting toner onto the recording sheet.

What is claimed is:

1. An image forming apparatus comprising:

a developer carrying member for carrying at least a charged developer in an image formation region;

a counter electrode which is disposed in opposing relation to the developer carrying member in the image formation region, supporting a recording member, and is applied with a predetermined voltage;

an insulating base which is disposed between the developer carrying member and the counter electrode and has a plurality of openings;

image signal electrodes which are provided around the respective openings in the insulating base in opposing relation to said developer carrying member, and impressed with an image signal for controlling the amount of developer supplied from the developer carrying member and passing through the openings being applied; and a control signal electrode which is provided on the insulating base in opposing relation to the counter electrode and is applied with a voltage always lower than the voltage applied to the image signal electrodes when a developer of negative polarity is used and is applied with a voltage always higher than the voltage applied to the image signal electrodes when a developer of positive polarity is used.

2. An image forming apparatus comprising:

a developer carrying member for carrying at least a charged developer in an image formation region;

a counter electrode which is disposed in opposing relation to the developer carrying member in the image formation region, supporting a recording member, and is applied with a predetermined voltage;

an insulating base which is disposed between the developer carrying member and the counter electrode and has a plurality of openings;

image signal electrodes which are provided around the respective openings in the insulating base in opposing relation to said developer carrying member, and impressed with an image signal for controlling the amount of developer supplied from the developer carrying member and passing through the openings being; and a control signal electrode which is provided on the insulating base in opposing relation to the counter electrode and is applied with a voltage synchronized with the voltage image signal electrodes being applied to the control signal electrode, a voltage always lower than the voltage applied to the image signal electrodes being applied to the control signal electrode when a developer of negative polarity is used, and a voltage always higher than the voltage applied to the image signal electrodes when a developer of positive polarity is used.

3. An image forming apparatus comprising:

a developer carrying member for carrying at least a charged developer in an image formation region;

a counter electrode which is disposed in opposing relation to the developer carrying member in the image formation region, supporting a recording member, and is applied with a predetermined voltage;

an insulating base which is disposed between the developer carrying member and the counter electrode and has a plurality of openings;

image signal electrodes which are provided on the insulating base in opposing relation to said developer carrying member, and impressed with the image signal electrodes being formed in a plurality of rows to surround the respective openings, the image signal electrodes in di different rows being electrically connected to each other to form a plurality of groups, different voltages being applied to the image signal electrodes in different groups during dot formation and during non-dot formation; and control signal electrodes which are provided on the insulating base in opposing relation to the counter electrode, the control signal electrodes forming groups corresponding to the individual rows of the openings, different voltages being applied to the control signal electrodes in-different groups during dot formation and during non-dot formation.

4. The image forming apparatus according to claim 3, wherein high-voltage power-source control means for controlling the voltage applied to the control signal electrodes applies a voltage always lower than the voltage applied to the image signal electrodes when a developer of negative polarity is used and applies a voltage always higher than the voltage applied to the image signal electrodes when a developer of positive polarity is used.

5. An image forming apparatus comprising:

a developer carrying member for carrying at least charged particles in an image formation region;

a counter electrode which is disposed in opposing relation to the developer carrying member in the image formation region, supporting a recording member, and is applied with a predetermined voltage;

an insulating base which is disposed between the developer carrying member and the counter electrode and has a plurality of openings;

image signal electrodes which are provided around the respective openings in the insulating base in opposing relation to said developer carrying member, and impressed with an image signal for controlling the amount of developer supplied from the developer carrying member and passing through the openings being applied;

a control signal electrode provided on the insulating base in opposing relation to the counter electrode and controlling the behavior of the developer that has passed through the openings;

image signal switching means for applying a continuous variable voltage to the image signal electrodes; and control signal switching means for applying said continuous variable voltage to the control signal electrode.

6. The image forming apparatus according to claim 5, wherein the control signal applied to the control signal electrodes is a repetitive signal synchronized with the image signal applied to the image signal electrodes and shifted in phase from the image signal.

7. The image forming apparatus according to claim 5, wherein the control signal applied to the control signal electrodes is a repetitive signal synchronized with the image signal applied to the image signal electrodes, having a voltage varying in one period, and shifted in phase from the image signal.

8. The image forming apparatus according to claim 5, wherein the control signal applied to the control signal electrodes is a repetitive signal synchronized with the image signal applied to the image signal electrodes and having a repetitive variable voltage at a potential having a difference gradually increasing in one period between itself and the potential of each of the image signal electrodes.

9. The image forming apparatus according to claim 5, wherein a voltage of a polarity opposite to the polarity of charge of the developer is applied to the control signal during an early stage of each period of the image signal electrodes.

10. The image forming apparatus according to claim 5, wherein a voltage obtained by changing a ratio between a voltage at which the developer can pass through the openings and a voltage at which the developer cannot pass through the openings is applied to the image signal electrodes to control the density of an image formed on the recording member.

11. The image forming apparatus according to claim 5, wherein the voltage applied to the image signal electrodes is a repetitive variable voltage having a value varying in one period.

12. An image forming method, comprising the steps of:

carrying at least a charged developer by using a developer carrying member in an image formation region;

placing a recording member on a counter electrode in opposing relation to the developer carrying member in the image formation region and applying a predetermined voltage to the counter electrode;

applying a predetermined image signal to image signal electrodes provided on an insulating base having a plurality of openings and disposed between the developer carrying member and the recording member such that the image signal electrodes surround the respective openings in opposing relation to the developer carrying member and thereby controlling the amount of developer supplied from the developer carrying member and passing through the openings;

applying a predetermined control signal to a control signal electrode provided on the insulating base in opposing relation to the counter electrode and thereby controlling the behavior of the developer that has passed through the openings; and applying, to the control signal electrode, a voltage always lower than the voltage applied to the image signal electrodes when a developer of negative polarity is used and applying a voltage always higher than the voltage applied to the image signal electrodes when a developer of positive polarity is used.

13. An image forming method, comprising the steps of:

carrying at least a charged developer by using a developer carrying member in an image formation region;

placing a recording member on a counter electrode in opposing relation to the developer carrying member in the image formation region and applying a predetermined voltage to the counter electrode;

applying a predetermined image signal to image signal electrodes provided on an insulating base having a plurality of openings and disposed between the developer carrying member and the recording member such that the image signal electrodes surround the respective openings in opposing relation to the developer carrying member and thereby controlling the amount of developer supplied from the developer carrying member and passing through the openings; and applying a predetermined control signal to a control signal electrode provided on the insulating base in opposing relation to the counter electrode and thereby controlling the behavior of the developer that has passed through the openings, the control signal applied to the control signal electrode being a repetitive signal synchronized with the image signal applied to the image signal electrodes and shifted in phase from the image signal.

14. The image forming method according to claim 13, wherein a voltage obtained by changing a ratio between a voltage at which charged particles can pass through the openings and a voltage at which the charged particles cannot pass through the openings is applied to the image signal electrodes to control the density of an image formed on the recording member.

15. The image forming method according to claim 13, wherein the voltage applied to the image signal electrodes is a repetitive variable voltage having a value varying in one period.

16. An image forming method, comprising the steps of:

carrying at least a charged developer by using a developer carrying member in an image formation region;

placing a recording member on a counter electrode in opposing relation to the developer carrying member in the image formation region and applying a predetermined voltage to the counter electrode;

applying a predetermined image signal to image signal electrodes provided on an insulating base having a plurality of openings and disposed between the developer carrying member and the recording member such that the image signal electrodes surround the respective openings in opposing relation to the developer carrying member and thereby controlling the amount of developer supplied from the developer carrying member and passing through the openings; and applying a predetermined control signal to a control signal electrode provided on the insulating base in opposing relation to the counter electrode and thereby controlling the behavior of the developer that has passed through the openings, the voltage applied to the control signal electrode being a repetitive variable voltage having the same period as the image signal voltage and a value varying in one period.

17. The image forming method according to claim 16, wherein the control signal is shifted in phase from the image signal.

18. The image forming method according to claim 16, wherein the voltage applied to the control signal is a repetitive variable voltage at a potential having a difference gradually increasing in one period between itself and the potential of each of the image signal electrodes.

19. The image forming method according to claim 16, wherein a voltage of a polarity opposite to the polarity of charge of the developer is imparted to the control signal electrode during an early stage of each period of the image signal.

* * * * *

UNITED STATES PATENT AND TRADEMARK OFFICE

CERTIFICATE OF CORRECTION

PATENT NO. : 6,409,314 B1
DATED : June 25, 2002
INVENTOR(S) : Yoshitaka Kitaoka et al.

It is certified that error appears in the above-identified patent and that said Letters Patent is hereby corrected as shown below:

Title page,
Item [56], References Cited, FOREIGN PATENT DOCUMENTS, should read as follows:
-- JP 04334463 Abstract Soichiro 11/20/92 --;
-- JP 06087231 Abstract Shinji 03/29/94 --;
-- JP 6-87231 Patent Masaichi 10/09/93 --;
-- JP 05293999 Abstract Masaichi 11/09/93 --.

Signed and Sealed this

Thirty-first Day of December, 2002

JAMES E. ROGAN
*Director of the United States Patent and Trademark Office*